US011079712B2

(12) United States Patent
Noguchi et al.

(10) Patent No.: US 11,079,712 B2
(45) Date of Patent: Aug. 3, 2021

(54) IMAGE FORMING APPARATUS FOR AN INTERMEDIATE TRANSFER OF A TONER IMAGE AND FOR REVERSELY TRANSFERRING COLLECTED DEVELOPER TO AN IMAGE BEARING MEMBER

(71) Applicant: CANON KABUSHIKI KAISHA, Tokyo (JP)

(72) Inventors: Bunro Noguchi, Mishima (JP); Taku Watanabe, Susono (JP); Yusaku Iwasawa, Mishima (JP); Yuichiro Hirata, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/450,107

(22) Filed: Jun. 24, 2019

(65) Prior Publication Data

US 2020/0004194 A1 Jan. 2, 2020

(30) Foreign Application Priority Data

Jun. 29, 2018 (JP) ..... JP2018-125005
Apr. 17, 2019 (JP) ..... JP2019-078792

(51) Int. Cl.
*G03G 21/00* (2006.01)
*G03G 15/16* (2006.01)

(52) U.S. Cl.
CPC ..... *G03G 21/0064* (2013.01); *G03G 15/168* (2013.01); *G03G 15/1665* (2013.01); *G03G 15/1675* (2013.01); *G03G 21/0011* (2013.01); *G03G 21/0035* (2013.01)

(58) Field of Classification Search
CPC ..... G03G 21/0011; G03G 21/0035; G03G 21/0064; G03G 15/1665; G03G 15/1675; G03G 15/168
See application file for complete search history.

(56) References Cited

U.S. PATENT DOCUMENTS

2008/0253807 A1* 10/2008 Soda ..... G03G 21/0064 399/129
2016/0291523 A1* 10/2016 Noguchi ..... G03G 15/161

FOREIGN PATENT DOCUMENTS

| | | | |
|---|---|---|---|
| JP | H0950167 | A | 2/1997 |
| JP | 2009205012 | A | 9/2009 |
| JP | 2010-112992 | A | 5/2010 |
| JP | 2016-191829 | A | 11/2016 |

* cited by examiner

*Primary Examiner* — Joseph S Wong
(74) *Attorney, Agent, or Firm* — Canon U.S.A., Inc. I.P. Division

(57) ABSTRACT

An image forming apparatus including a holding apparatus configured to collect residual developer remaining on an intermediate transfer belt and temporarily hold the residual developer, and a cleaning member configured to remove toner borne on the photosensitive drum that moves the toner held by the holding apparatus to the intermediate transfer belt and discharging the toner. Toner from a development roller is supplied to the cleaning member before toner reversely transferred from the intermediate transfer belt is supplied to the cleaning member.

12 Claims, 24 Drawing Sheets

IMAGE FORMING APPARATUS FOR AN INTERMEDIATE TRANSFER OF A TONER IMAGE AND FOR REVERSELY TRANSFERRING COLLECTED DEVELOPER TO AN IMAGE BEARING MEMBER

BACKGROUND OF THE DISCLOSURE

Field of the Disclosure

The present disclosure relates to an image forming apparatus employing an intermediate transfer method for transferring a toner image formed on an image bearing member onto an intermediate transfer member and then transferring the toner image onto a transfer material.

Description of the Related Art

Conventionally, an in-line color type image forming apparatus having a plurality of image bearing members disposed in the rotational direction of an intermediate transfer member is known as an image forming apparatus such as a laser beam printer.

The image forming apparatus develops an electrostatic latent image formed on a photosensitive drum as an image bearing member into a toner image via a development unit and primarily transfers the toner image onto the intermediate transfer member. Then, the image forming apparatus repetitively performs similar primary transfer operations for a plurality of colors to form a full color toner image on the intermediate transfer member. Subsequently, the image forming apparatus secondarily transfers the full color toner image onto a recording material and then permanently fixes the full color toner image to the recording material via a fixing unit. At this timing, it is necessary to remove toner (residual transfer toner) remaining on the intermediate transfer member, untransferred to the transfer material in a secondary transfer process, from the intermediate transfer member.

Japanese Patent Application Laid-Open No. 9-50167 discusses a method for removing residual transfer toner from an intermediate transfer member, what is called a simultaneous transfer-and-collection system. More specifically, residual transfer toner on the intermediate transfer member is charged to the opposite polarity to the normal charging state of toner by a toner charging unit so that the residual transfer toner is reversely transferred onto a photosensitive drum in the following primary transfer process. The toner reversely transferred onto the photosensitive drum is removed by a cleaning unit such as a cleaning blade.

Japanese Patent Application Laid-Open No. 2009-205012 discusses a method for using a conductive brush member and a conductive roller member as a collection system for preventing image defect by uniformly scattering residual transfer toner (hereinafter referred to as residual secondary transfer toner) on an intermediate transfer member and uniformly charging toner. More specifically, by applying a direct-current (DC) voltage to the brush member disposed on the upstream side, the secondary residual transfer toner on the intermediate transfer member is mechanically scattered, primarily collected, and charged. The secondary residual transfer toner which passed the brush member is charged by the roller member disposed on the downstream side.

The configuration discussed in Japanese Patent Application Laid-Open No. 2009-205012 makes it possible to perform toner collection at the same time as primary transfer for the following page, enabling continuous image forming without decreasing the print speed. In a series of continuous printing, secondary residual transfer toner of the last page is collected by a cleaning blade of a photosensitive drum in the non-image-forming period. Subsequently, by alternately applying a positive and a negative voltage to the brush member and the roller member, primary collection toner accumulated in the brush member is discharged onto the intermediate transfer member. The toner discharged onto the intermediate transfer member is reversely transferred onto the photosensitive drum in the primary transfer process and collected. When a large amount of primary collection toner exists in the brush member, for example, when many sheets are used in continuous printing, printing is once interrupted to maintain the toner charging performance of the brush member, providing a non-image forming state. Then, the toner accumulated in the brush member is discharged and reversely transferred onto the photosensitive drum in the primary transfer process and collected.

However, in the above-described configuration, the toner reversely transferred from the intermediate transfer member onto the photosensitive drum may not completely be cleaned by the cleaning blade of the photosensitive drum, resulting in vertical streaks in an image.

The phenomenon occurs because the charge amount of toner reversely transferred from the intermediate transfer member onto the photosensitive drum is larger than usual. A layer of toner external additive (additive particles added to toner particles as auxiliary particles) moved from toner to the photosensitive drum is formed at the edge portion of the cleaning blade of the photosensitive drum. The layer has a role of a barrier for cleaning (hereinafter referred to as a blocking layer). However, if the charge amount of toner rushing into the blocking layer is larger than usual, the blocking layer is destructed by the rushing toner having a large adhesion to the photosensitive drum. Accordingly, faulty cleaning (toner passing through) occurs from the portion. Vertical streaks has occurred in an image for this reason. The problem is particularly noticeable in a case where a large amount of toner is reversely transferred. In addition, the phenomenon in which reversely transferred toner cannot be completely cleaned by the cleaning blade of the photosensitive drum may also occur in a case where a large amount of toner rushes into the cleaning blade even if the charge amount is not so higher than usual.

More specifically, there is a demand for an image forming apparatus capable of restricting or preventing faulty cleaning of a photosensitive drum even in a case where toner discharged from an intermediate transfer member is reversely transferred.

SUMMARY OF THE DISCLOSURE

According to an aspect of the present disclosure, an image forming apparatus includes a developer bearing member configured to bear developer containing additive particles, an image bearing member configured to develop the developer from the developer bearing member, an intermediate transfer member, a transfer member configured to be applied with a transfer bias for transferring a developer image developed on the image bearing member onto the intermediate transfer member, a holding apparatus configured to, after the developer image transferred on the intermediate transfer member has been transferred onto a recording material, collect residual developer remaining on the intermediate transfer member and temporarily hold the residual developer, and a cleaning member configured to, while in contact with the image bearing member, remove the developer borne by the image bearing member. In the image forming apparatus that performs operations for moving first developer held by the holding apparatus to the intermediate transfer member and then reversely transferring the first developer from the intermediate transfer member to the image bearing member, the developer bearing member supplies second developer to the image bearing member such that the developer from the developer bearing member is supplied to the cleaning member before the developer reversely transferred is supplied to the cleaning member.

Further features and aspects of the present disclosure will become apparent from the following description of example embodiments with reference to the attached drawings.

DESCRIPTION OF THE EMBODIMENTS

Numerous example embodiments of the present disclosure will be exemplarily described in detail below with reference to drawings. However, sizes, materials, shapes, and relative arrangements of elements described in the present example embodiments are not limited thereto and are to be modified as required depending on the configuration of an apparatus according to the present disclosure and various conditions. The scope of the present disclosure is not limited to the example embodiments described below.

An image forming apparatus according to a first example embodiment is capable of discharging toner. More specifically, the image forming apparatus discharges toner from a toner charging brush attached to an intermediate transfer member in the non-image-forming period and, immediately before collecting toner onto a photosensitive drum, sends toner from a development roller to the photosensitive drum. The image forming apparatus can prevent faulty cleaning by forming a blocking layer in a cleaning blade edge portion and then collecting the discharge toner from the toner charging brush onto the photosensitive drum in this way.

(1) Overview of Configuration and Operations of Image Forming Apparatus

Figure 1:
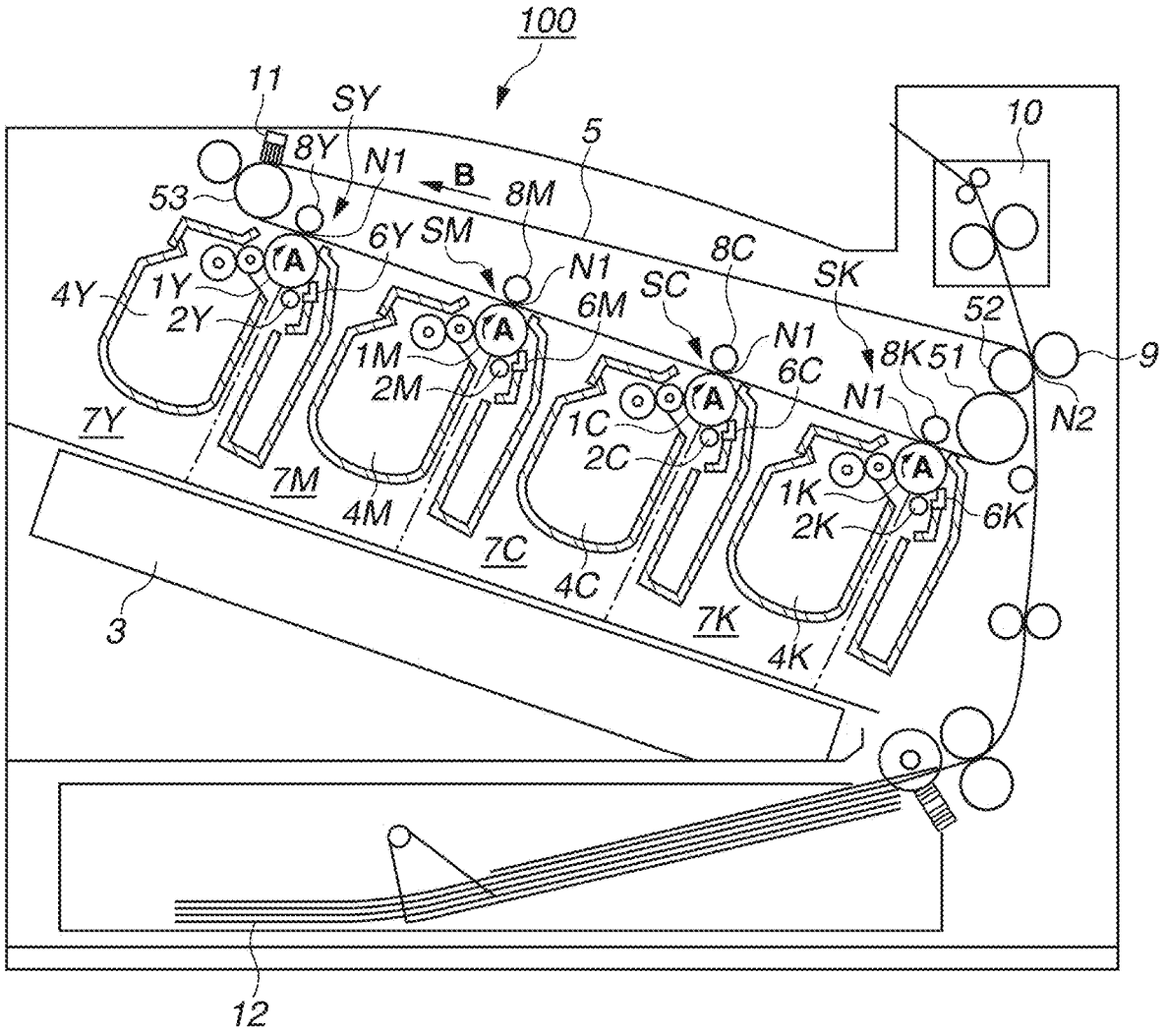
FIG. 1 is a cross-sectional view illustrating an image forming apparatus according to an example embodiment.

An overall configuration of an electrophotographic image forming apparatus (image forming apparatus) according to the present disclosure will be described below. FIG. 1 is a cross-sectional view schematically illustrating an image forming apparatus 100 according to the present example embodiment. The image forming apparatus 100 according to the present example embodiment is a full color laser beam printer adopting an in-line system and an intermediate transfer system. The image forming apparatus 100 is capable of forming a full color image on a recording material (for example, recording paper) based on image information. The image information is input to the main body of the image forming apparatus 100 from a host apparatus such as an image reading apparatus connected to the main body of the image forming apparatus 100 or a personal computer communicably connected to the main body of the image forming apparatus 100.

The image forming apparatus 100 includes a plurality of image forming units: a first image forming unit SY for forming an yellow (Y) image, a second image forming unit SM for forming a magenta (M) image, a third image forming unit SC for forming a cyan (C) image, and a fourth image forming unit SK for forming a black (K) image. According to the present example embodiment, the first to the fourth image forming units SY, SM, SC, and SK are juxtaposed along an intermediate transfer belt. The image forming unit S includes a primary transfer roller 8 and a process cartridge 7.

According to the present example embodiment, the configurations and operations of the first to the fourth image forming units are substantially identical except for the color of an image to be formed. Therefore, if it is not necessary to make a distinction, subscripts Y, M, C, and K supplied to reference numerals to represent colors assigned to elements will be omitted to make descriptions comprehensive.

According to the present example embodiment, the image forming apparatus 100 includes four photosensitive drums 1 along the intermediate transfer belt, as a plurality of image bearing members. A photosensitive drum 1 is rotatably driven by a drive unit (drive source, not illustrated) in the direction (clockwise rotation) indicated by the arrow A. Around the photosensitive drum 1, there are disposed a charging roller 2 (charging member) as a charging unit for uniformly charging the surface of the photosensitive drum 1, and a scanner unit (exposure apparatus) 3 as an exposure unit for forming an electrostatic image (electrostatic latent image) on the photosensitive drum 1 by irradiating the photosensitive drum 1 with laser based on the image information. Around the photosensitive drum 1, there are disposed a development unit (development apparatus) 4 as a development unit for developing an electrostatic image into a toner image, and a cleaning blade 6 as a cleaning unit for removing toner (residual transfer toner) remaining on the surface of the photosensitive drum 1 after toner transfer. The cleaning blade 6 is in contact with the surface of the photosensitive drum 1 at a contact portion. In addition, an intermediate transfer belt 5 as an intermediate transfer member for transferring a toner image on the photosensitive drum 1 onto a recording material 12 is disposed to face the four photosensitive drums 1.

According to the present example embodiment, the photosensitive drum 1, the charging roller 2 as a process unit for acting on the photosensitive drum 1, the development unit 4, and the cleaning blade 6 are integrated into a process cartridge 7. Each process cartridge 7 corresponds to each image forming unit. The process cartridges 7 are detachably attached to the image forming apparatus 100. According to the present example embodiment, the process cartridges 7 for respective colors have the same shape and store yellow (Y), magenta (M), cyan (C), and black (K) toner.

The intermediate transfer belt 5 formed of an endless belt as an intermediate transfer member rotates in the direction (counterclockwise rotation) indicated by the arrow B while in contact with all of the photosensitive drums 1. The intermediate transfer belt 5 is stretched over a plurality of supporting members: a drive roller 51, a secondary transfer counter roller 52, and a driven roller 53. Four primary transfer rollers 8 (transfer members 8) as primary transfer units are juxtaposed on the inner circumferential surface of the intermediate transfer belt 5 so as to face the respective photosensitive drums 1. Each primary transfer roller 8 is applied with a bias having the polarity opposite to the normal charging polarity of toner, by a primary transfer bias power source (not illustrated). Thus, toner images on the photosensitive drums 1 are transferred onto the intermediate transfer belt 5. In addition, on the outer circumferential surface of the intermediate transfer belt 5, a secondary transfer roller 9 as a secondary transfer unit is disposed at a position facing the secondary transfer counter roller 52. The secondary transfer roller 9 is applied with a bias having the polarity opposite to the normal charging polarity of toner by a secondary transfer bias power source (not illustrated). Thus, a toner image on the intermediate transfer belt 5 is transferred onto the recording material 12.

In the image-forming period, the surface of the photosensitive drum 1 is uniformly charged by the charging roller 2. Subsequently, an electrostatic image based on the image information is formed on the photosensitive drum 1 by laser light according to the image information emitted from the scanner unit 3. Subsequently, the electrostatic image is developed on the image bearing member (on the photosensitive drum 1) as a toner image by the development unit 4 and then transferred (primarily transferred) onto the intermediate transfer belt 5 by the action of the primary transfer roller 8.

For example, during full color image forming, the above-described process is sequentially performed by the first to fourth image forming units SY, SM, SC, and SK in this order. Then, toner images of the respective colors are overlapped on top of each other on the intermediate transfer belt 5. Subsequently, a 4-color toner image formed on the intermediate transfer belt 5 is collectively secondarily transferred onto the recording material 12. The recording material 12 is applied with heat and pressure by a fixing apparatus 10, and the toner image is fixed thereon. Primary residual transfer toner remaining on the photosensitive drum 1 after the primary transfer process is removed and collected by the cleaning blade 6.

Secondary residual transfer toner remaining on the intermediate transfer belt 5 after the secondary transfer process is applied with charge having the polarity opposite to the normal charging polarity of toner (charging polarity of the developer for developing an electrostatic latent image) by a toner charging brush 11. The secondary residual transfer toner is also applied with charge having the polarity opposite to the normal charging polarity by a discharging charging roller 54 (a power source 40R). Then, the secondary residual transfer toner applied with charge by the toner charging brush 11 and the discharging charging roller 54 is reversely transferred onto the photosensitive drum 1 of the first image forming unit and then collected by the cleaning blade 6 in the following primary transfer process. The function of applying charge to toner may be performed only by the toner charging brush 11.

[Process Cartridge]

Figure 2:
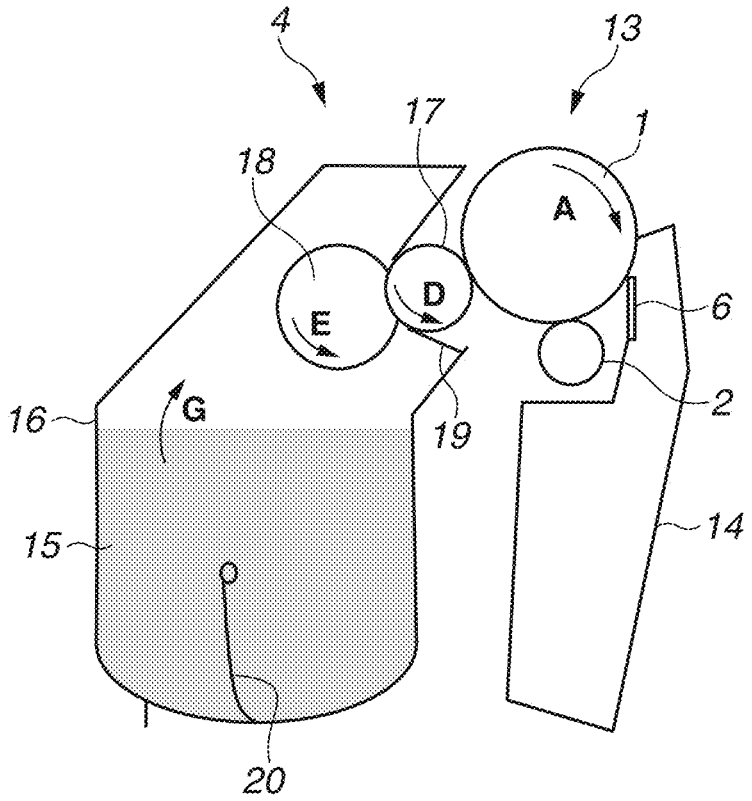
FIG. 2 is a cross-sectional view illustrating a process cartridge according to an example embodiment.

The following describes an overall configuration of the process cartridge 7 attached to the image forming apparatus 100 according to the present example embodiment. FIG. 2 is a cross-sectional view schematically illustrating the process cartridge 7 according to the present example embodiment when viewed from the longitudinal direction (rotational axis direction) of the photosensitive drum 1. According to the present example embodiment, the configuration and operations of the process cartridge 7 for each color are identical except for the type (color) of the stored developer.

The process cartridge 7 includes a photosensitive unit 13 including the photosensitive drum 1, and the development unit 4 including a development roller 17.

The photosensitive unit 13 includes a cleaning frame member 14 for supporting various elements in the photosensitive unit 13. The photosensitive drum 1 is rotatably attached to the cleaning frame member 14 via a bearing (not illustrated). When the driving force of a drive motor as a drive unit (drive source) is transmitted to the photosensitive unit 13, the photosensitive drum 1 is rotatably driven in the direction (clockwise rotation) indicated by the arrow A according to the image forming operation. The photosensitive drum 1 corresponding to the center of the image forming process uses an organic photosensitive member made of an aluminum cylinder of which the outer circumferential surface is coated with functional films (an undercoat layer, a career generation layer, and a career transfer layer) in this order.

The photosensitive unit 13 includes the cleaning member 6 and the charging roller 2 disposed in contact with the circumferential surface of the photosensitive drum 1. Residual transfer toner removed from the surface of the photosensitive drum 1 by the cleaning member 6 falls into the cleaning frame member 14 and is stored therein.

The charging roller 2 as a charging unit is driven to rotate with the roller portion made of conductive rubber in pressure contact with the photosensitive drum 1. In the charging process, the metal core of the charging roller 2 is applied with a predetermined direct-current (DC) voltage with respect to the photosensitive drum 1. A uniform dark-area potential (Vd) is formed on the surface of the photosensitive drum 1. The photosensitive drum 1 is exposed to a spot pattern of laser light emitted from the scanner unit 3 according to image data. At exposed portions, charge is eliminated from the surface by careers from the career generation layer, and the potential is lowered. As a result, an electrostatic latent image is formed on the photosensitive drum 1, with exposed portions set to a predetermined light-area potential (Vl) and unexposed portions set to a predetermined dark-area potential (Vd).

The development unit 4 includes the development roller 17 (developer bearing member), a development blade 19, a toner supply roller 18, toner 15, and a toner storage chamber 16 for storing the toner 15. The toner 15, nonmagnetic spherical toner with a particle diameter of 7 μm, is charged to the negative polarity as the normal polarity. The surface of the toner 15 is applied with silica particles with a particle diameter of 20 nm as a toner external additive (additive particles).

The development blade 19 contacts the development roller 17 in a countering way to restrict the amount of coating of toner supplied by the toner supply roller 18 and to apply charge to toner. The development blade 19 is made of a thin plate-like member which forms contact pressure by using spring elasticity of the thin plate. The surface of the development blade 19 contacts toner and the development roller 17. When toner is frictioned by the development blade 19 and the development roller 17, toner is triboelectrically charged, i.e., applied with charge. At the same time, the thickness of toner is restricted. According to the present example embodiment, a predetermined voltage is applied to the development blade 19 by a blade bias power source (not illustrated), stabilizing the toner coat.

The development roller 17 and the photosensitive drum 1 rotate so that the surfaces thereof move in the same direction (from the bottom upward, as indicated by the arrows A and D in the present example embodiment) at the facing portion (contact portion). According to the present example embodiment, toner is triboelectrically negatively charged with respect to a predetermined DC bias applied to the development roller 17. At the development portion in contact with the photosensitive drum 1, charged toner is transferred only to light-area potential portions because of the potential difference, thus visualizing an electrostatic latent image.

The toner supply roller 18 disposed to form a predetermined nip portion on the circumferential surface of the development roller 17 rotates in the direction (counterclockwise rotation) indicated by the arrow E. The toner supply roller 18 is an elastic sponge roller made of a conductive metal core and a foam formed around the metal core. The toner supply roller 18 and the development roller 17 are in contact with each other with a predetermined inroad amount. At the contact portion, the toner supply roller 18 and the development roller 17 rotate in opposite directions. In this operation, the toner supply roller 18 supplies toner to the development roller 17 and removes the toner remaining on the development roller 17 after development.

A toner agitation member 20 is disposed in the toner storage chamber 16. The toner agitation member 20 agitates the toner stored in the toner storage chamber 16 and conveys the toner toward the upper part of the toner supply roller 18, i.e., in the direction indicated by the arrow G. According to the present example embodiment, both the development roller 17 and the toner supply roller 18 have an outside diameter of φ20. The inroad amount of the toner supply roller 18 into the development roller 17 is set to 1.5 mm. According to the present example embodiment, the development roller 17 is applied with a predetermined DC bias. At the development portion in contact with the photosensitive drum 1, toner is transferred only to light-area potential portions because of the potential difference, thus visualizing an electrostatic latent image.

[Development Roller Contact and Separation Mechanism]

Figure 3:
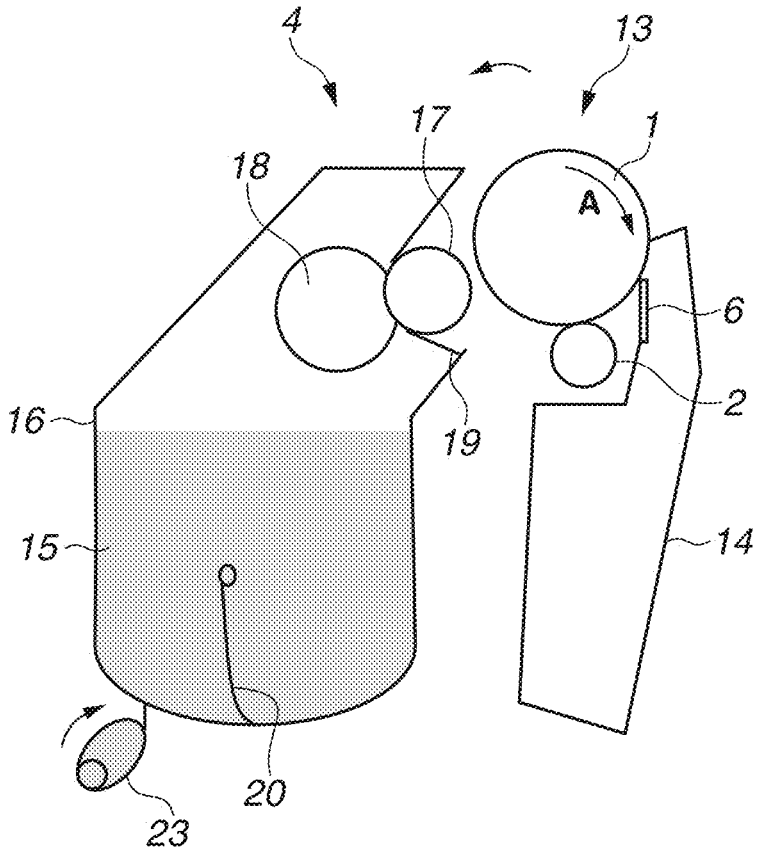
FIG. 3 is a cross-sectional view illustrating the process cartridge when a development roller is separated according to an example embodiment.

The development roller 17 is configured to be separable from and in pressure contact with the photosensitive drum 1. A development roller contact and separation mechanism performs control in the following way. In the image forming period, the mechanism makes the development roller 17 and the photosensitive drum 1 in contact with each other. In the non-image-forming period, the mechanism separates the development roller 17 and the photosensitive drum 1 from each other, as illustrated in FIG. 3, to stop the drive of the development roller 17. The image forming period refers to a period during which the developer is transferred from the development roller 17 based on the electrostatic latent image formed on the photosensitive drum 1 to form a developer image. The non-image-forming period refers to a period during which the above-described developer image is not formed, for example, a period after the image forming (hereinafter referred to as a post-rotation) since the time when a developer image is formed on the photosensitive drum 1 till the time when the photosensitive drum 1 stops and a period before the image forming (hereinafter referred to as a pre-rotation) since the time when the following printing is started and the photosensitive drum 1 starts rotating till the time when a developer image starts being formed. The post-rotation refers to a period since the time when the toner image forming on the photosensitive drum 1 is completed till the time when the photosensitive drum 1 stops. In the post-rotation period, a collection operation for residual transfer toner on the intermediate transfer member to the photosensitive drum 1 and a falling operation for each bias are performed. The pre-rotation is a period since the time when the photosensitive drum 1 starts rotating till the time when a toner image is formed on the photosensitive drum 1. In the pre-rotation period, a rising operation for each bias and a pre-heating operation of the fixing apparatus 10 are performed. The non-image-forming period also refers to a period equivalent to a period between the conveyance of a plurality of recording materials 12 during continuous printing, and to a specially provided period during which no developer image is formed, for example, during an operation for adjusting the image density and an operation for discharging toner adhering to the toner charging brush 11.

The contact and separation mechanism specifically includes a cam 23 disposed in the image forming apparatus 100 to control the rotation position, and a spring member (not illustrated) disposed in the process cartridge 7 to apply pressure so that the development roller 17 and the photosensitive drum 1 contact each other. In the contact state of the developing roller 17, the cam 23 controls the development unit 4 to move to the position where pressure is not applied, and the spring member of the process cartridge 7 applies pressure to keep the contact state. In the separated state of the development roller 17, the rotation position of the cam 23 is controlled to press the development unit 4 from the bottom to rotate the development unit 4.

The contact and separation mechanism is not limited to a mechanism using the above-described cam 23 and spring member. A mechanism using only the cam 23 is also applicable without problem as long as contact and separation can be controlled.

[Intermediate Transfer Belt]

As the intermediate transfer belt 5, a film made of polyvinylidene fluoride having a thickness of 100 μm and a volume resistivity of $10^{11}$ ohms cm is used. The intermediate transfer belt 5 is stretched by three axes: the drive roller 51, the secondary transfer counter roller 52, and the driven roller 53.

[Primary Transfer Roller]

As the primary transfer roller 8, an elastic roller having a volume resistivity of $10^5$ to $10^9$ ohms cm and a rubber hardness of 30 degrees (Asker C hardness meter) is used. The primary transfer roller 8 is pressed onto the photosensitive drum 1 via the intermediate transfer belt 5 with a total pressure of 9.8 N. The primary transfer roller 8 is driven to rotate by the rotation of the intermediate transfer belt 5. In addition, the primary transfer roller 8 can be applied with a voltage of −2.0 to 3.5 kV by a primary transfer power supply (not illustrated).

[Toner Charging Brush]

As the toner charging brush 11, a brush configured to achieve approximately dense nylon fibers having a conductivity of $10^6$ to $10^9$ ohms cm is used. The toner charging brush 11 is fixedly disposed. According to the present example embodiment, the tip position of the toner charging brush 11 is set such that the inroad amount to the surface of the intermediate transfer belt 5 becomes 1.0 mm. The toner charging brush 11 located on the upstream side in the moving direction of the surface of the intermediate transfer belt 5 frictions the surface of the intermediate transfer belt 5 with the movement of the intermediate transfer belt 5. The toner charging brush 11 is disposed more on the downstream side of the secondary transfer portion and more on the upstream side of the first image forming unit in the moving direction of the intermediate transfer belt 5. The toner charging brush 11 can be applied with a voltage of −2.0 to +2.0 kV by a high-voltage power source (not illustrated) as a toner charging brush voltage supply unit.

(2) Description of Operations in Secondary Residual Transfer Toner Collection

[Method for Collecting Secondary Residual Transfer Toner]

A method for collecting secondary residual transfer toner performed during printing will be described below.

Secondary residual transfer toner remains on the intermediate transfer belt 5 after the secondary transfer process. The toner charging brush 11 is applied with a +1-kV bias having the polarity opposite to the normal charging polarity of toner, i.e., a positive +1-kV bias, according to the present example embodiment. When secondary residual transfer toner passes the toner charging brush 11, the toner is charged to the positive polarity. At this timing, part of negative toner which has not been fully charged to the positive polarity is held by the toner charging brush 11. In the primary transfer process, the secondary residual transfer toner applied with positive charge by the toner charging brush 11 is reversely transferred onto the photosensitive drum 1Y of the first image forming unit and collected by the cleaning blade 6. In continuous printing, control is performed such that the secondary residual transfer on the last page is collected onto the photosensitive drum 1Y of the first image forming unit in the non-image-forming period.

[Toner Charging Brush Discharge Process]

A process for discharging toner from the toner charging brush 11 will be described in detail below.

As described above, negative toner which has not been fully charged to the positive polarity by the toner charging brush 11 is temporarily held by the toner charging brush 11. More specifically, the toner charging brush 11 also functions as a holding apparatus for collecting and holding residual developer remaining on the intermediate transfer member after secondary transfer. If image forming is repeatedly performed, toner is accumulated in the toner charging brush 11 and the electrical resistance increases, degrading the charging performance of the toner charging brush 11. Therefore, a process for discharging toner held by the toner charging brush 11 onto the intermediate transfer belt 5 is required. The discharge process according to the present example embodiment includes a period of post-rotation and a period for performing a discharge process different from the process in the image forming period.

In this process, since toner to be discharged is negative toner (the same polarity as toner in the development period), the toner cannot be transferred onto the photosensitive drum 1 at the primary transfer portion in the image-forming period. Therefore, in the non-image-forming period, the toner charging brush 11 is applied with a negative −1-kV bias having a polarity that is the same as the normal charging polarity of toner, instead of a positive +1-kV bias in the present example embodiment, to discharge toner onto the intermediate transfer belt 5. A positive bias and a negative bias are alternately applied to the toner charging brush 11 10 times at 0.2-second intervals. Toner will be discharged 10 times when a −1-kV bias is applied. In this process, the toner accumulated in the toner charging brush 11 is discharged onto the intermediate transfer belt 5.

The following describes the reason why a positive bias and a negative bias are alternately applied. In the toner charging brush 11, generally, the brush hair is clogged with collected toner. It is difficult to discharge the clogged toner only by applying a bias having the opposite polarity. Accordingly, the toner charging brush 11 is alternately applied with a high-voltage positive and a high-voltage negative bias. The toner charging brush 11 is mechanically vibrated by electrostatic force, and the clogged toner is discharged by the vibration. This is the reason why a positive bias and a negative bias are alternately applied to the toner charging brush 11.

The following describes a method for collecting the toner discharged from the toner charging brush 11 onto the photosensitive drum 1. Since the toner charging brush 11 is applied with a positive bias in the image-forming period, negative toner is basically accumulated. However, positive toner is also partly contained in the negative toner. According to the present example embodiment, positive and negative discharge toner is respectively distributed to the first to fourth image forming units and collected. More specifically, the primary transfer rollers 8 are applied with a −1.5-kV bias having a polarity that is the same as the normal charging polarity of toner in the second and third image forming units, and applied with a +1.5-kV bias having the polarity opposite to the normal charging polarity of toner in the first and fourth image forming units. In this way, the negative toner discharged from the toner charging brush 11 is reversely transferred onto the photosensitive drums 1Y and 1K and collected, and the positive toner discharged from the toner charging brush 11 is reversely transferred onto the photosensitive drums 1M and IC and collected. The toner reversely transferred onto the photosensitive drums 1 is collected by the cleaning blades 6.

According to the above-described process, when there is a following image to be formed when all of discharge toner has been collected by the cleaning blades 6, pre-rotation is performed again to repeat the image forming process. When there is no more image to be formed, the operation ends.

The discharge process is periodically performed for a predetermined number of sheets in a period of post-rotation or a period for performing a discharge process different from the process in the image forming period. In addition, control is performed such that the frequency of the discharge process is increased with increasing printing rate of printed images. This is because the amount of toner accumulated in the toner charging brush 11 increases since the amount of secondary residual transfer toner increases with increasing printing rate of printed images. The discharge process according to the present example embodiment is performed once for 300 sheets when the average printing rate is 2% or less, once for 200 sheets when the average printing rate is 2 to 5%, once for 100 sheets when the average printing rate is 5 to 10%, once for 50 sheets when the average printing rate is 10 to 20%, and once for 25 sheets when the average printing rate is 20% or more. This prevents the discharge process from being excessively performed (to continue the printing operation as long as possible) while maintaining the performance of the toner charging brush 11.

[Power Source Configuration Block Diagram]

Figure 4:
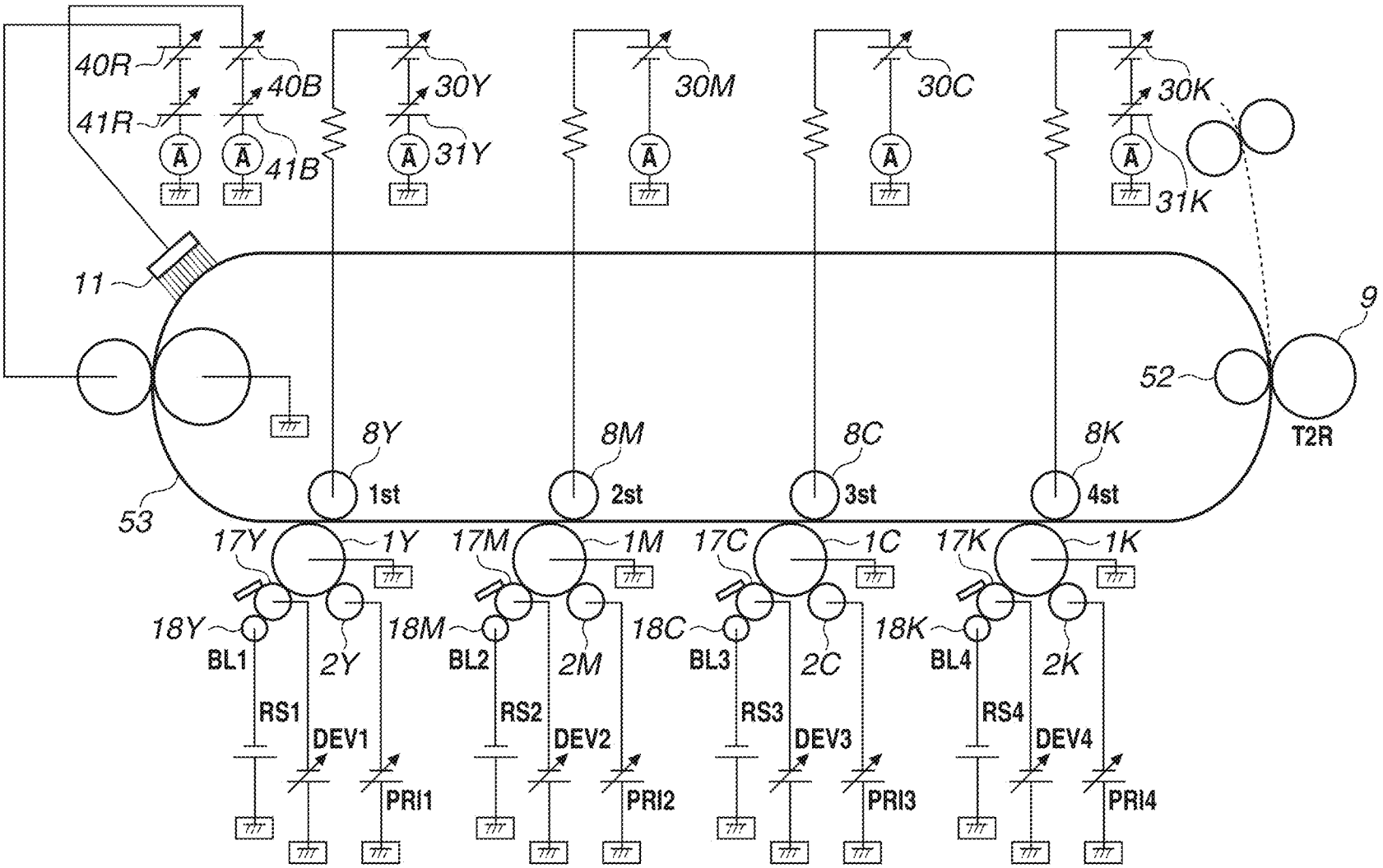
FIG. 4 is a block diagram illustrating a power source configuration of the image forming apparatus according to an example embodiment.

FIG. 4 is a block diagram illustrating a power source configuration of the image forming apparatus 100. For various process units, the same reference numerals as illustrated in FIG. 1 are assigned. A power source 30 applies a primary transfer bias to a primary transfer roller 8. The power sources 30 are configured to apply a positive transfer bias and a negative primary transfer bias to the primary transfer roller 8Y and the primary transfer roller 8K.

Each of the toner charging brush 11 and the discharging charging roller 54 is provided with a power source capable of applying a positive bias and a negative bias. At the timing T4 (discharge timing) illustrated in FIGS. 6 and 8, the toner charging brush 11 is applied with a positive bias and a negative bias by power sources 40B and 41B. At the timing T4 (discharge timing) illustrated in FIGS. 6 and 8, the discharging charging roller 54 is applied with a negative DC bias by the power source 41R. This aims for removing a negative developer adhering to the surface and preventing negative toner supplied when discharging toner from the toner charging brush 11, from adhering to the surface. Each of the charging roller 2, the primary transfer roller 8, and the development roller 17 is provided with an independent power source. In addition, some of power sources may be replaced with a common power source. These power supplies are controlled based on instructions of a control unit 101 (described below) to achieve bias application in the timing charts illustrated in FIGS. 6 and 8 (described below).

[Control Block Diagram]

Figure 5:
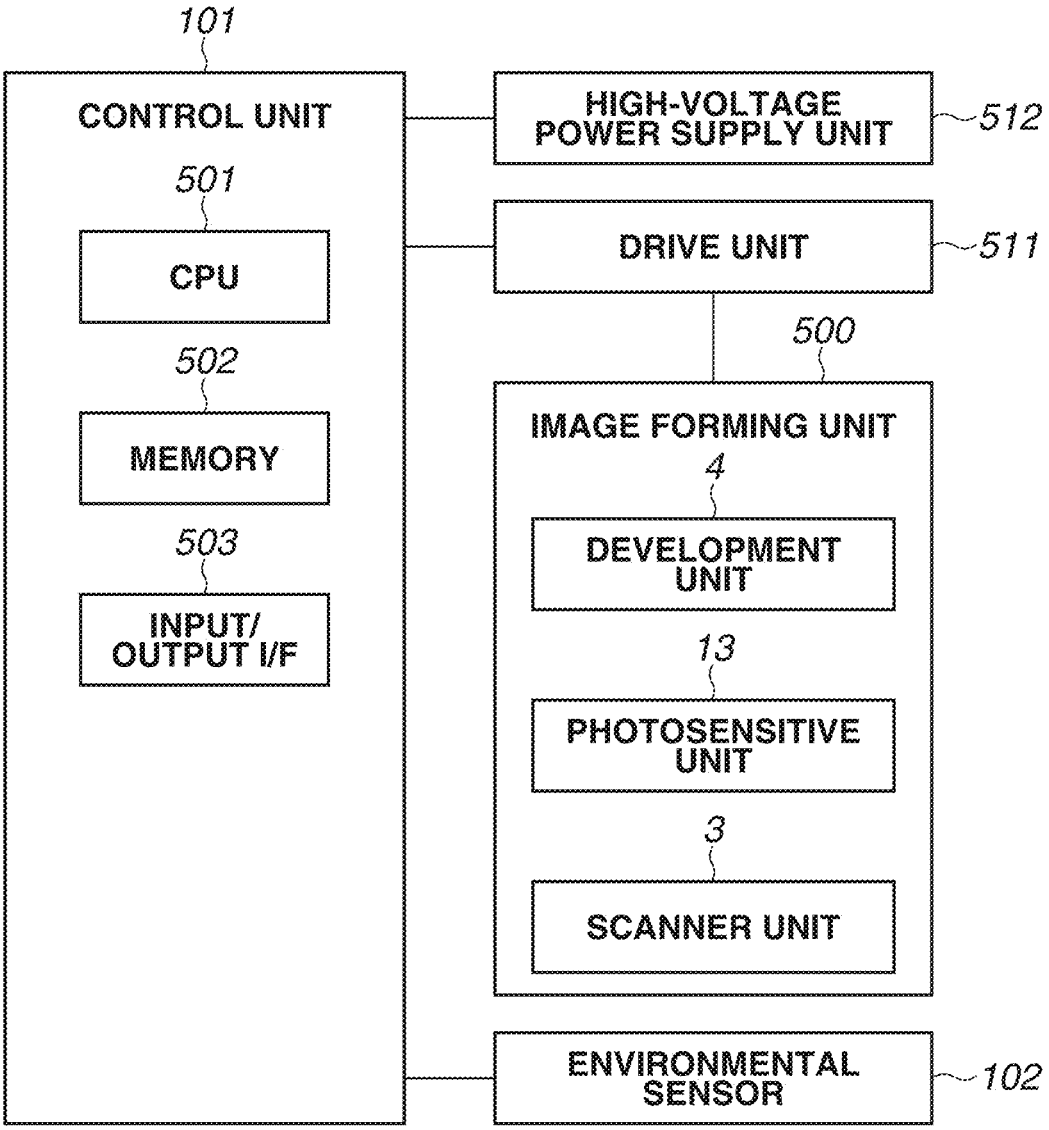
FIG. 5 is a block diagram illustrating control according to an example embodiment.

The following describes a block diagram illustrating control by the image forming apparatus 100, with reference to FIG. 5. The control unit 101 includes a central processing unit (CPU) 501 as a central element for performing calculation processing, a memory 502 such as a read only memory (ROM) and a random access memory (RAM), and an input/output interface (I/F) 503 for inputting and outputting information from/to peripheral devices. The RAM stores a sensor detection result and a calculation result. The ROM stores control programs and data tables acquired in advance. The control unit 101 totally controls operations of the image forming apparatus 100. Control targets for the image forming apparatus 100 are connected to the control unit 101 via the input/output I/F 503. The control unit 101 controls transmission and reception of various electrical information signals and drive timing and manages timing chart processing (described below).

A drive unit 511 refers to various motors and drive gears. The drive unit 511 collectively refers to power sources and power mechanisms for rotatably driving various rotary members included in the development units 4, the photosensitive units 13, and the scanner units 3, and operates based on control signals from the control unit 101. A high-voltage power source 512 collectively refers to power sources for applying high voltages to the charging rollers 2, the development rollers 17, the primary transfer rollers 8, the secondary transfer roller 9, and a fixing apparatus 34. The control unit 101 is connected with an environmental sensor 102, such as a temperature sensor, and therefore is capable of acquiring information about temperature, the amount of moisture in the air, and humidity based on detection signals from the environmental sensor 102.

(3) Description of Toner Discharge Sequence

According to the present example embodiment, immediately before the above-described process for discharging toner from the toner charging brush 11 in the non-image-forming period, the development roller 17 supplies a protection developer image to the photosensitive drum 1 to form a blocking layer.

Figure 6:
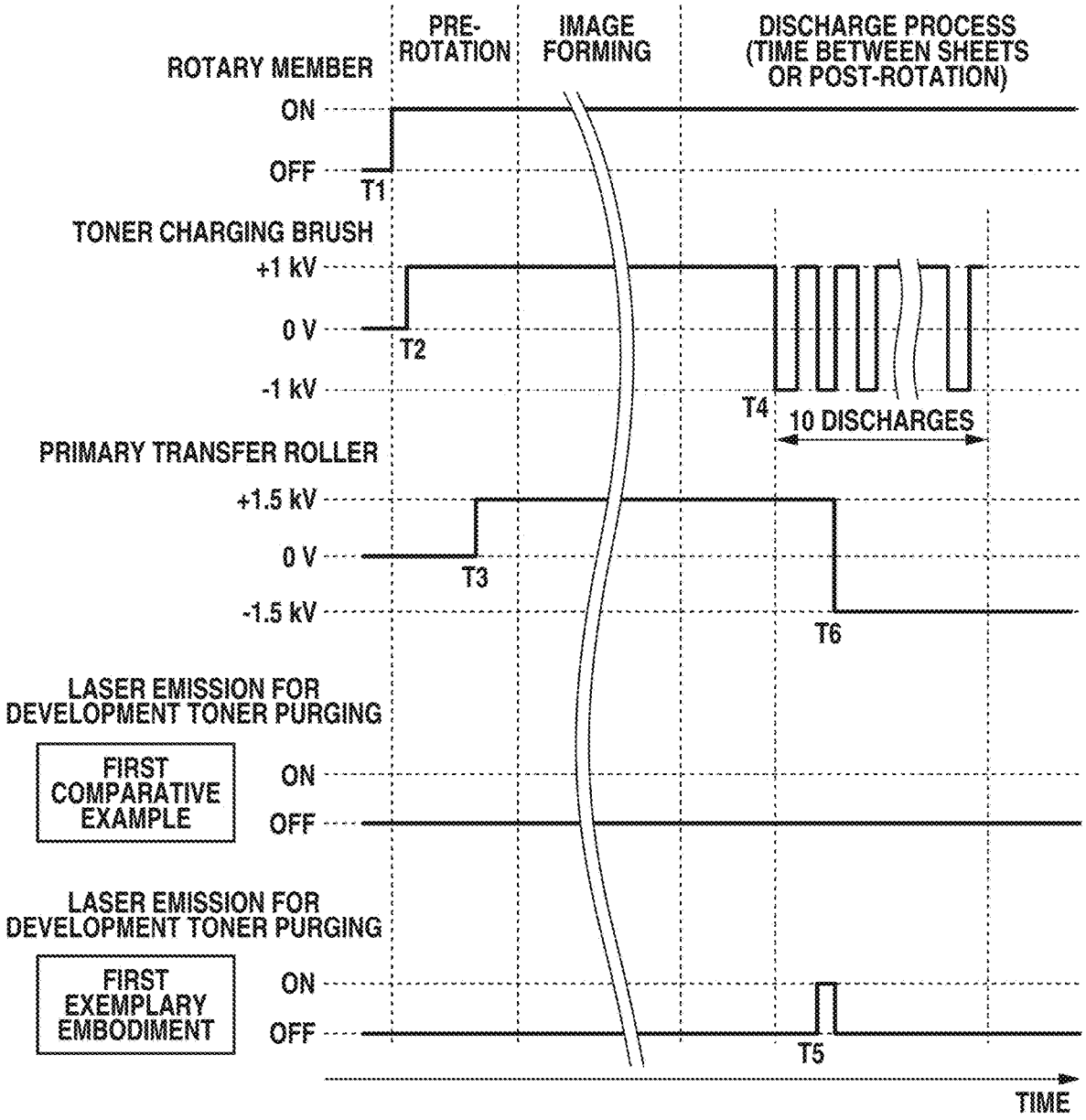
FIG. 6 is a timing chart illustrating a discharge process by a first image forming unit according to a first example embodiment, a first comparative example, and a second comparative example.

FIG. 6 is a timing chart illustrating a timing of starting and stopping the rotation of the photosensitive drum 1, a timing of applying a positive bias and a negative bias to the toner charging brush 11 and the primary transfer roller 8, and a timing of laser emission for toner purging from the development roller 17 in the first image forming unit. The timing of starting the rotation of the photosensitive drum 1 and the timing of changing the bias to be applied to the toner charging brush 11 and the primary transfer roller 8 in the process for discharging toner from the toner charging brush 11 are similar in the first comparative example, the second comparative example, and the first example embodiment. However, the control unit 101 performs the laser emission for forming a toner image (hereinafter referred to as a protection developer image) for supplying toner from the development roller 17 to the cleaning blade 6 of the photosensitive drum 1 in the first example embodiment and the second comparative example. The control unit 101 does not perform this laser emission in the first comparative example. The first example embodiment and the second comparative example differ in the image pattern of the protection developer image. Biases applied to the development roller 17 and the charging roller 2 in the discharge process are similar to those in the image-forming period. In addition, the development roller 17 and the photosensitive drum 1 are continuously in contact with each other since the image-forming period. The following describes in detail a timing of a protection developer image forming according to the first example embodiment and the second comparative example.

The following describes the first image forming unit with reference to FIG. 6. At the timing T1, the control unit 101 controls the drive unit 511 to start (turn on) the rotation of various rotary members. At the timing T2, the control unit 101 controls the high-voltage power source unit 512 to turn on the toner charging brush 11 to prepare for image forming. At the timing T3, the control unit 101 turns on the primary transfer roller 8. Although not illustrated, the charging roller 2, the development roller 17, the toner supply roller 18, the secondary transfer roller 9, and the fixing apparatus 10 start being applied with various biases by corresponding high-voltage power sources.

Then, after completion of the image forming operation, the discharge process is started. The situation after completion of the image forming operation is equivalent to the time between page images (what is called the time between sheets) and the above-described post-rotation.

At the timing T4, the control unit 101 controls the high-voltage power source unit 512 to alternately apply a +1-kV bias and a −1-kV bias to the toner charging brush 11. More specifically, the control unit 101 performs toner discharge by alternately fluctuating the bias between +1 and −1 kV 10 times at 0.2-second intervals. Thus, developer (first developer) discharged from the toner charging brush 11 is moved to the intermediate transfer belt 5.

At the timing T5, the control unit 101 controls the scanner unit 3 to perform the laser emission for the protection developer image. This laser emission forms an electrostatic latent image for the protection developer image on the photosensitive drum 1. Then, before the developer reversely transferred is supplied to the cleaning blade 6, developer (second developer) is supplied from the development roller 17 (developer bearing member) to the cleaning blade 6. The protection developer image according to the present example embodiment is what is called a 1-dot one space image in which a solid black horizontal line image with a 1-dot width (about 0.042 mm) and a blank image with a 1-dot width are alternately repeated in the entire image forming area in the rotational axis direction of the photosensitive drum 1. According to the first comparative example, the development roller 17 and the photosensitive drum 1 are only in contact with each other without the protection developer image in the discharge process.

At the timing T6, the control unit 101 controls the high-voltage power source unit 512 to apply a negative bias to the primary transfer roller 8Y. Referring to FIG. 6, when the protection developer image formed at the timing T5 passes the transfer portion formed by the primary transfer roller 8Y and the intermediate transfer belt 5, a negative reverse bias (having a polarity that is the same as the normal charging polarity of the developer) is applied to the primary transfer roller 8Y. However, the present disclosure is not limited thereto. It is confirmed that, even if the transfer bias applied to the primary transfer roller 8Y is turned off or if a transfer bias having a small positive value is applied to the primary transfer roller 8Y, a fixed amount of the protection developer is supplied to the cleaning blade 6.

Figure 7:
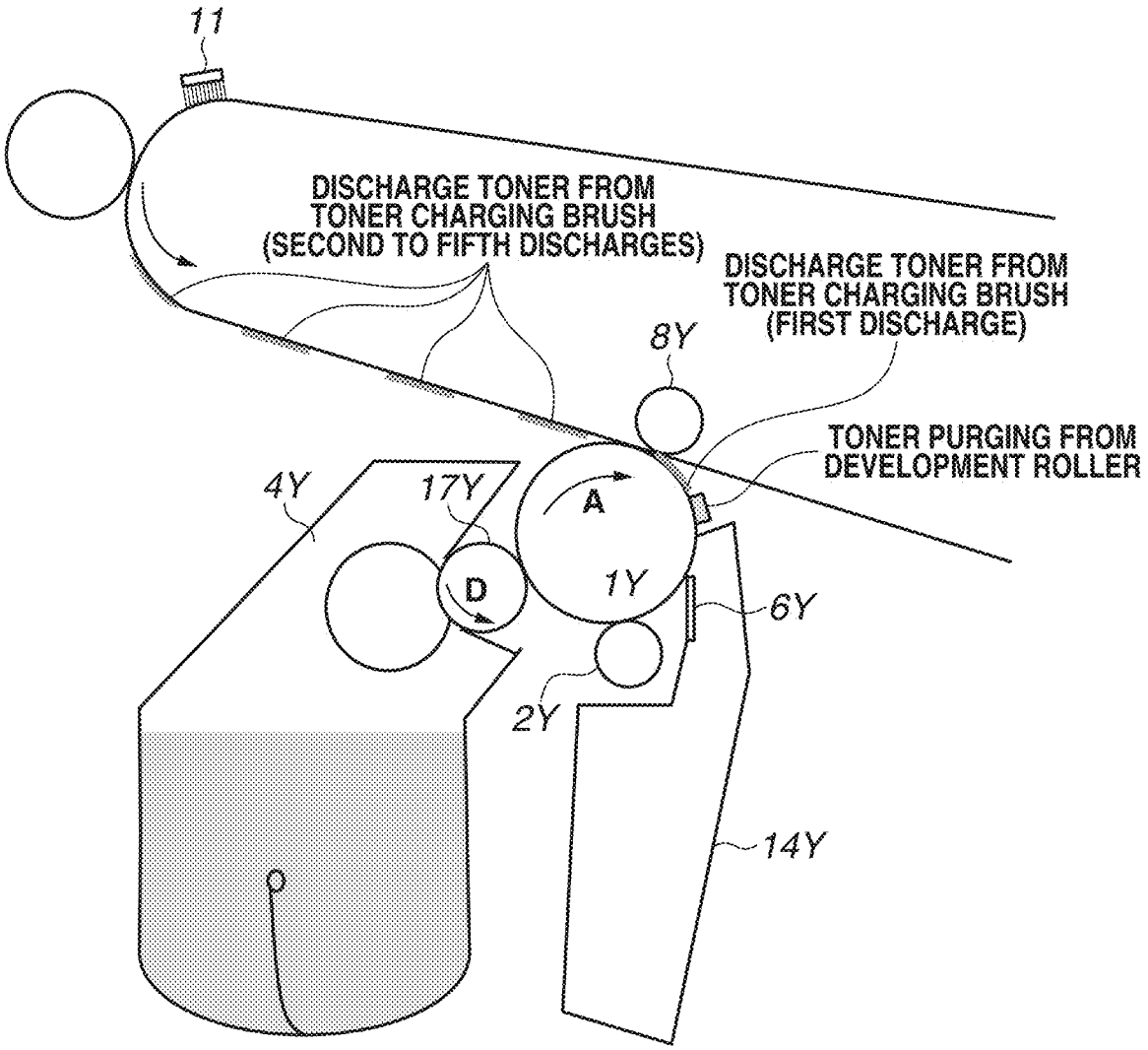
FIG. 7 is a cross-sectional view illustrating an image forming apparatus for describing a bias application timing of a toner charging brush, a primary transfer roller, and a development roller according to the first example embodiment.

Relations between the timings T4 to T6 will be described below with reference to FIG. 7. As illustrated in FIG. 7, according to the present first example embodiment and the second comparative example, toner for the protection developer image comes on the upstream side of the first discharge toner from the toner charging brush 11, on the photosensitive drum 1Y. The process speed (the rotational speed of the photosensitive drum 1 and the intermediate transfer belt 5) according to the present first example embodiment is 200 mm/s. Referring to positional relations between members, a distance L1 from the toner charging brush 11 to the position where the photosensitive drum 1Y of the first image forming unit contacts the intermediate transfer belt 5 is 150 mm. A distance L2 from the position of laser irradiation on the photosensitive drum 1Y by the scanner unit 3 to the position where the photosensitive drum 1Y contacts the intermediate transfer belt 5 is 50 mm. According to the present first example embodiment with this configuration, with reference to the timing when the toner charging brush 11 starts being applied with a discharge bias (−1 kV), the discharge toner from the toner charging brush 11 reaches the position where the photosensitive drum 1Y contacts the intermediate transfer belt 5, in 0.75 seconds. To supply the protection developer image to the cleaning blade 6 before this timing, the scanner unit 3 performs the laser emission for the protection developer image at 0.4 seconds after the toner charging brush 11 is applied with the discharge bias. The developed protection developer image reaches the position (contact portion) where the photosensitive drum 1Y contacts the intermediate transfer belt 5 in 0.65 seconds. To collect (reversely transfer) the negative discharge toner from the toner charging brush 11 onto the photosensitive drum 1, the control unit 101 applies a negative bias to the primary transfer roller 8Y to prevent the negative toner of the protection developer image from being transferred onto the intermediate transfer belt 5. For specific example, the control unit 101 changes the bias to the primary transfer roller 8Y to −1.5 kV at 0.5 seconds after the toner charging brush 11 is applied with the discharge bias (timing T6). The control unit 101 performs the above-described control to supply the toner for the protection developer image before collecting the discharge toner from the toner charging brush 11 to the cleaning blade 6Y in the first image forming unit. This means that, after forming a blocking layer at the edge portion of the cleaning blade 6, the discharge toner from the toner charging brush 11 is collected by the photosensitive drum 1, making it possible to prevent faulty cleaning at the discharge timing. In addition, the time period in seconds since the time when the toner charging brush 11 is applied with the discharge bias till the time when the scanner unit 3 performs the laser emission for the protection developer image is suitably determined by the distance L2 and the diameter of and the photosensitive drum 1.

The following describes the timing when the second image forming unit forms a protection developer image. The second image forming unit is disposed on the downstream side of the first image forming unit.

The second image forming unit mainly collects positive toner that has not completely been collected in the first image forming unit out of the discharge toner from the toner charging brush 11. At this timing, like the case of the first image forming unit, the control unit 101 perform control such that the protection developer image comes on the upstream side of the first discharge toner from the toner charging brush 11 on the photosensitive drum 1M as a second image bearing member. The protection developer image is supplied from the development roller 17M as a second developer bearing member. The protection developer image is negative toner, and positive discharge toner is to be collected from the toner charging brush 11. Therefore, the bias applied to the primary transfer roller 8M (second transfer member) differs from the bias in the first image forming unit.

Figure 8:
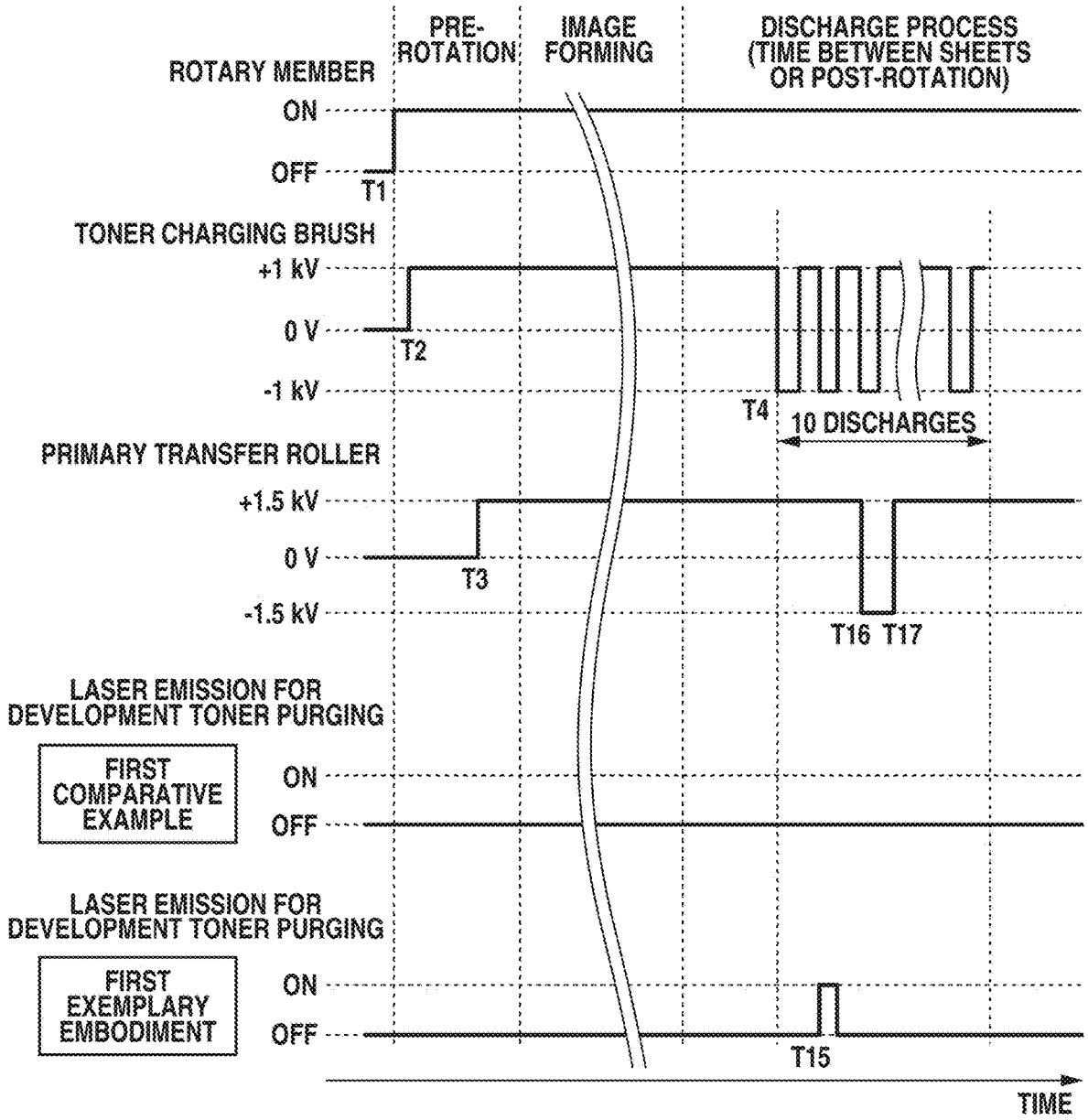
FIG. 8 is a timing chart illustrating a discharge process by a second image forming unit according to the first example embodiment, the first comparative example, and the second comparative example.

The following describes the second image forming unit with reference to FIG. 8. Processing at the timings T1 to T4 is similar to the processing in the first image forming unit, and detailed descriptions thereof will be omitted. In the second image forming unit, a distance L12 from the toner charging brush 11 to the position (second transfer portion) where the photosensitive drum 1M of the second image forming unit contacts the intermediate transfer belt 5 is 250 mm. The distance L12 is 100 mm longer than the distance L1. Under the control of the control unit 101, the toner discharged from the toner charging brush 11 at the timing T4 reaches the position (transfer nip) where the photosensitive drum 1M contacts the intermediate transfer belt 5, in 1.25 seconds. With reference to the timing when the toner charging brush 11 is applied with the discharge bias, the control unit 101 performs the laser emission for the protection developer image (fourth developer) in 0.8 seconds (timing T15), and the protection developer image reaches the position where the photosensitive drum 1M contacts the intermediate transfer belt 5, in 1.05 seconds. At this timing, to prevent the negative toner for the protection developer image from being transferred onto the intermediate transfer belt 5, the control unit 101 changes the bias of the primary transfer roller 8M to −1.5 kV at 0.95 seconds after the toner charging brush 11 is applied with the discharge bias (timing T16). To collect the positive discharge toner from the toner charging brush 11 onto the photosensitive drum 1M, the control unit 101 changes the bias of the primary transfer roller 8M to +1.5 kV at 1.15 seconds after the toner charging brush 11 is applied with the discharge bias (timing T17). The timings T15 to T17 may be the same as the timings T4 to T6 according to the first example embodiment. The timing when a part of the protection developer image (second developer) reversely untransferred in the first image forming unit reaches the second transfer portion formed by the primary transfer roller 8M and the intermediate transfer belt 5 is referred to as a first timing. The timing when the protection developer image (fourth developer) in the second image forming unit reaches the second previous transfer portion is referred to as a second timing. The first timing differs from the second timing. When the first and the second timings are matched, untransferred toner having a higher density reaches the secondary transfer portion, causing a problem of stain at the secondary transfer portion.

The control unit 101 controls the third image forming unit, like the above-described second image forming unit, such that the protection developer image is collected by the cleaning blade 6C before the discharge toner from the toner charging brush 11 is collected. The control unit 101 controls the fourth image forming unit, like the above-described first image forming unit, such that the protection developer image is collected by the cleaning blade 6K before the discharge toner from the toner charging brush 11 is collected.

The following describes the comparison of the cleaning performance when the discharge process is actually performed under the conditions of the first example embodiment, the first comparative example, and the second comparative example. As a common condition, a horizontal line image for each color with a 1% printing rate was printed as a durability image on 4,000 sheets. In the middle of printing, each time continuous printing is performed on 2,000 sheets, a halftone image for each color with a 25% printing rate was printed as a cleaning characteristic evaluation image to confirm image defect (vertical streaks). This printing was performed by the image forming apparatus 100 installed in an environment at 23-degree temperature and 50% humidity.

According to the second comparative example, in a state where the development roller 17 contacts the photosensitive drum 1 in the discharge process, a 1-dot horizontal line is purged as the protection developer image for a total of 30 dots. According to the first example embodiment, as described above, in a state where the development roller 17 contacts the photosensitive drum 1 in the discharge process, a 1-dot horizontal line is purged as the protection developer image for a total of 40 dots.

TABLE 1

Durability image evaluation result for faulty cleaning

| | Development toner purging in discharge process | Vertical streak image Initial state | 2,000 sheets | 4,000 sheets |
|---|---|---|---|---|
| First comparative example | None | ○ | x | x |
| Second comparative example | 30-dot horizontal line | ○ | ○ | * |
| First example embodiment | 40-dot horizontal line | ○ | ○ | ○ |

○: Vertical streaks not generated
* Vertical streaks slightly generated
x: Vertical streaks generated As illustrated in Table 1, vertical streaks were generated because of faulty cleaning according to the first comparative example, and vertical streaks were slightly generated according to the second comparative example. However, in the configuration according to the first example embodiment, faulty cleaning was not generated. This is because the cleaning performance is improved for the following reason. When the protection developer image is supplied, the external additive (additive particles) moves to the photosensitive drum 1, and a blocking layer having a role of a barrier layer is formed at the edge portion of the cleaning blade 6.

Figure 9:
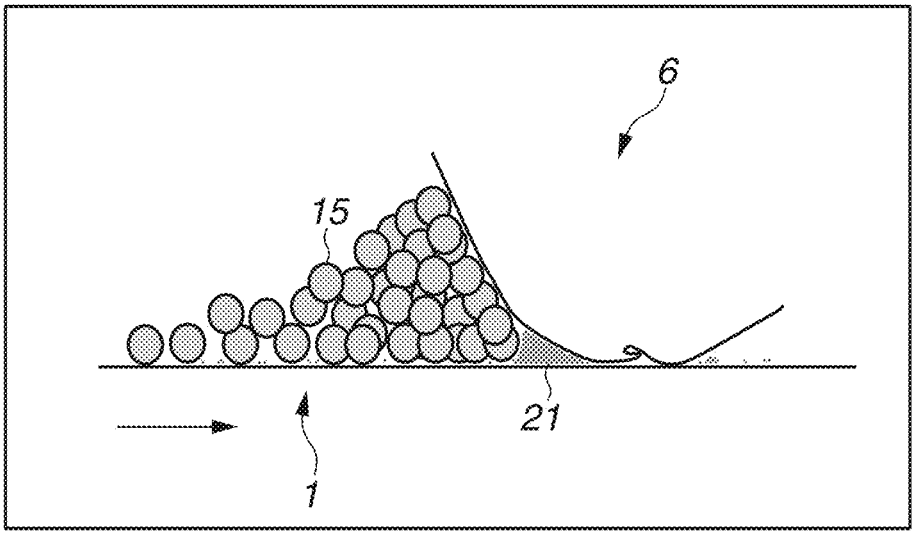
FIG. 9 is an enlarged view illustrating a relation between a cleaning blade edge portion and a blocking layer.

The following describes a mechanism for improving the cleaning performance with reference to an enlarged view of the edge portion of the cleaning blade 6 illustrated in FIG. 9. As illustrated in FIG. 9, the cleaning blade 6 contacts the photosensitive drum 1 in the counter-rotational direction of the photosensitive drum 1, i.e., the edge portion of the cleaning blade 6 is rolled by the rotation of the photosensitive drum 1. The toner external additive moved to the photosensitive drum 1 accumulates in the wedge-like portion where the edge portion of the cleaning blade 6 is rolled, to form a layer (hereinafter this layer is referred to as a blocking layer 21). If toner is cleaned without the blocking layer 21, toner is likely to get in from the wedge-like portion where the edge portion of the cleaning blade 6 is rolled, inducing faulty cleaning. If the blocking layer 21 exists at the edge portion of the cleaning blade 6 (contact portion) as illustrated in FIG. 9, toner does not get in, improving the cleaning performance. Meanwhile, since the blocking layer 21 is formed of toner external additive with a diameter of about 20 nm, a fixed amount of external additive is constantly fallen out from the edge portion of the cleaning blade 6. Toner discharged from the toner charging brush 11 in the discharge process is applied with toner charge of −65 to −100 μC/g by the bias of the toner charging brush 11. The charge amount of the toner held by the development roller 17 is about −30 μC/g. With the increase in toner charge, the adhesion to the photosensitive drum 1 increases, making the toner more likely to make inroads into the blocking layer 21 with the rotation of the photosensitive drum 1 and to destroy the blocking layer 21. Since the discharge toner from the toner charging brush 11 is likely to cause faulty cleaning, a sufficient blocking layer 21 needed to be formed before the discharge toner collection. Therefore, according to the present example embodiment, immediately before the discharge toner collection, a protection developer image is formed on the photosensitive drum 1 in order to form a sufficient amount of the blocking layer 21. Referring to Table 1, a 30-dot horizontal line is slightly insufficient and a 40-dot horizontal line is required as the amount of the protection developer required to prevent faulty cleaning due to discharge toner collection.

As described above, the use of the configuration according to the present example embodiment enables preventing a vertical streak image due to faulty cleaning even when toner is collected from the toner charging brush 11.

According to a second example embodiment, in contrast to the first example embodiment, the negative-side fluctuation range of the bias to be applied to the toner charging brush 11 in the discharge process is not constant but gradually increased. Other configurations are similar to those according to the first example embodiment. The bias configuration as described in the present example embodiment can decrease the amount of toner discharged at one time from the toner charging brush 11, preventing a vertical streak image due to faulty cleaning.

Figure 10:
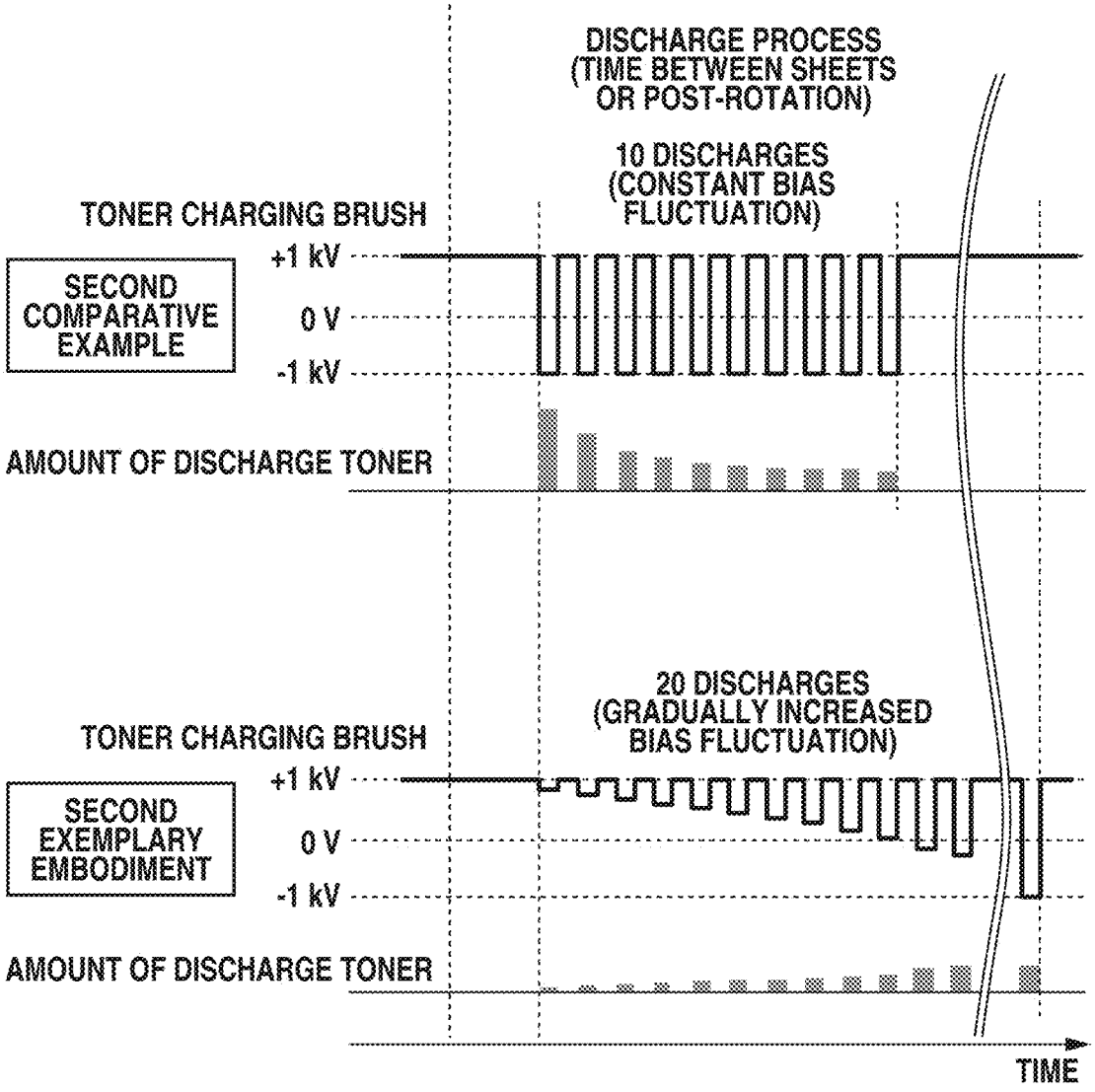
FIG. 10 illustrates bias application of the toner charging brush in a discharge process according to a second example embodiment and the second comparative example.

The following describes the bias to be applied to the toner charging brush 11 in the discharge process, based on the comparison between the second comparative example and the second example embodiment, with reference to FIG. 10. FIG. 10 illustrates the amount of the discharge toner from the toner charging brush 11 with vertical bars. The larger length of the vertical bars indicates the larger amount of discharge toner. According to the second comparative example, toner discharge is performed by alternately fluctuating the bias to be applied to the toner charging brush 11 between +1 and −1 kV 10 times at 0.2-second intervals. In this discharge method, the amount of discharge toner is deviated to the tip side, as illustrated in FIG. 10.

According to the second example embodiment, the bias to be applied to the toner charging brush 11 is alternately fluctuated at 0.2-second intervals, like the second comparative example. However, as illustrated in FIG. 10, the bias is fluctuated between +1 kV and +900 V for the first time and between +1 kV and +800 V for the second time. Since the fluctuation range of the bias is increased in 100-V steps in this way, the bias is fluctuated between +1 and −1 kV for the 20th time. Gradually increasing the fluctuation range enables restricting the amount of the toner discharged at one time to a small amount, as illustrated in FIG. 10. However, the total amount of discharge toner is equalized in the second example embodiment and the second comparative example to maintain the performance of the toner charging brush 11. Therefore, in the second example embodiment, the number of discharges is set to 20 which is twice the number in the second comparative example. In addition, the development roller 17 and the photosensitive drum 1 are continuously in contact with each other since the image-forming period.

Negatively charged toner is held at the tip of the toner charging brush 11 by an applied positive +1-kV bias. Although, according to the second example embodiment illustrated in FIG. 10, the bias fluctuation is repeated within a positive bias range in the early stage, the toner accumulated at the tip of the toner charging brush 11 by a weak force is discharged first as the applied positive bias gradually decreases. Then, the toner accumulated at the tip of the toner charging brush 11 by a strong force is discharged as the applied positive bias decreases. Then, when a positive bias and a negative bias are alternately applied with increasing fluctuation range of the applied bias, clogged toner in the toner charging brush 11 described in the first example embodiment is discharged. Gradually increasing the fluctuation range of the applied bias of the toner charging brush 11 enables equalizing the amount of discharge toner. When this equalization is performed, the amount of discharge toner per unit area decreases resulting in an effect of the increase in the reverse transfer efficiency. Even if the cleaning capability of the cleaning blade 6 is degraded, a large amount of toner is not supplied to the cleaning blade 6 at one time, preventing faulty cleaning.

The following describes the comparison of the cleaning performance when the discharge process is actually performed. As common conditions, a horizontal line image for each color with a 1% printing rate was printed as a durability image on 4,000 sheets. In the middle of printing, each time continuous printing is performed on 2,000 sheets, a halftone image for each color with a 25% printing rate was printed as a cleaning characteristic evaluation image to confirm image defect (vertical streaks). This printing was performed by the image forming apparatus 100 installed in an environment at 23-degree temperature and 50% humidity. According to the second comparative example and the second example embodiment, a 30-dot horizontal line was used as the protection developer image in the discharge process.

TABLE 2

Durability image evaluation result for faulty cleaning

| | Development toner | Discharge from toner charging brush | | | | |
|---|---|---|---|---|---|---|
| | purging in discharge process | Bias fluctuation | Number of repetitions | Vertical streak image: Initial state | 2,000 sheets | 4,000 sheets |
| Second comparative example | 30-dot horizontal line | Constant | 10 | ○ | ○ | * |
| Second example embodiment | 30-dot horizontal line | Gradually increased | 20 | ○ | ○ | ○ |

○: Vertical streaks not generated
*: Vertical streaks slightly generated

As illustrated in Table 2, according to the second comparative example, slight vertical streaks due to faulty cleaning occurred. In the configuration according to the second example embodiment, faulty cleaning was not generated even if the protection developer image is a 30-dot horizontal line. The reason why faulty cleaning was not generated in the configuration according to the second example embodiment is as follows. Since the amount of the toner discharged from the toner charging brush 11 at one time decreases, the blocking layer 21 is not destroyed at once, making toner unlikely to pass through the cleaning blade 6.

As described above, the use of the configuration according to the present example embodiment enables preventing a vertical streak image due to faulty cleaning even if the amount of the protection developer is a 30-dot horizontal line which is smaller than a 40-dot horizontal line according to the first example embodiment. This makes it possible to restrain excessive toner consumption by the protection developer image.

The control unit 101 may perform control to gradually fluctuate the bias to be applied to the toner charging brush 11 according to the present example embodiment only when the environmental sensor 102 detects a predetermined temperature or below. Faulty cleaning is more likely to occur in a lower-temperature environment where the rubber elastic coefficient of the cleaning blade 6 decreases to degrade the traceability for the photosensitive drum 1. Therefore, by performing control according to the present example embodiment, for example, only when the temperature of 25 degrees or below is detected, faulty cleaning can be prevented without increasing the number of bias fluctuations more than required.

A third example embodiment will be described below. According to the first and the second example embodiments, in the toner discharge sequences illustrated in FIGS. 6 and 8, the first and fourth image forming units has collected toner applied with negative charge supplied from the toner charging brush 11, and the second and third image forming units has collected toner applied with positive charge supplied from the toner charging brush 11. However, the present disclosure is not limited thereto. For example, the first and fourth image forming units may collect toner applied with positive charge, and the second and third image forming units may collect toner applied with negative charge. An arbitrary image forming unit is used to collect toner (developer) having an arbitrary polarity.

Other Example Embodiments

Although, in the first to third example embodiments, the first to fourth image forming units supply the same amount of the protection developer image, an image forming unit more on the downstream side may supply a smaller amount of the protection developer image. In this case, since an image forming unit more on the downstream side collects a smaller amount of the discharge toner from the toner charging brush 11, faulty cleaning is not likely to occur. Therefore, the amount of the protection developer in the image forming units on the downstream side may be reduced. More specifically, the amount of the protection developer supplied by the second image forming unit may be smaller than the amount of the protection developer supplied by the first image forming unit.

Although, in the present example embodiment, the protection developer image has been supplied immediately before the collection of the discharge toner from the toner charging brush 11, the protection developer image may be additionally supplied immediately after the collection of discharge developer (first developer) from the toner charging brush 11. Although faulty cleaning does not occur after the collection of the discharge toner from the toner charging brush 11, faulty cleaning may possibly occur afterward because of the decreased amount of the blocking layer 21. To compensate the blocking layer 21, the control unit 101 supplies the protection developer image (third developer) like the cases at the timing T5 illustrated in FIG. 6 and at the timing T15 illustrated in FIG. 8 immediately after the collection of the discharge toner from the toner charging brush 11.

According to each of the above-described example embodiments, it is possible to provide an image forming apparatus capable of restricting or preventing faulty cleaning of the photosensitive drum 1 even if toner discharged from the intermediate transfer member is reversely transferred.

A fourth example embodiment will be described below. In each of the above-described example embodiments, when a large amount of toner needs be collected at one time by the above-described brush member, the toner temporarily collected first is pushed deeply into the brush member by toner collected afterwards. In this case, even if a positive reverse bias is applied, the toner pushed deeply into the brush member cannot be discharged (hereinafter referred to as clogged toner). Clogged toner is held by the brush portion when charged. However, if the toner is uncharged after a long-term neglect, the clogged toner falls on the intermediate transfer member by a shock during activation of the image forming apparatus, possibly soiling the secondary transfer member and the back surface of paper. Although a possible solution for solving this problem is to constantly collect a large amount of toner, this solution is not desirable because of a low productivity. More specifically, there has been a demand for an image forming apparatus capable of discharging toner accumulated in a brush member, with a sufficient productivity. Such an image forming apparatus will be described below. The overview of the configuration and operations, process cartridge, development roller contact and separation mechanism, intermediate transfer belt, toner charging brush, secondary residual transfer toner collection method, toner charging brush discharge process, and power source configuration block diagram of the image forming apparatus are similar to those according to the third and fourth example embodiments, and detailed descriptions thereof will be omitted.

<Control Block Diagram>

Figure 11:
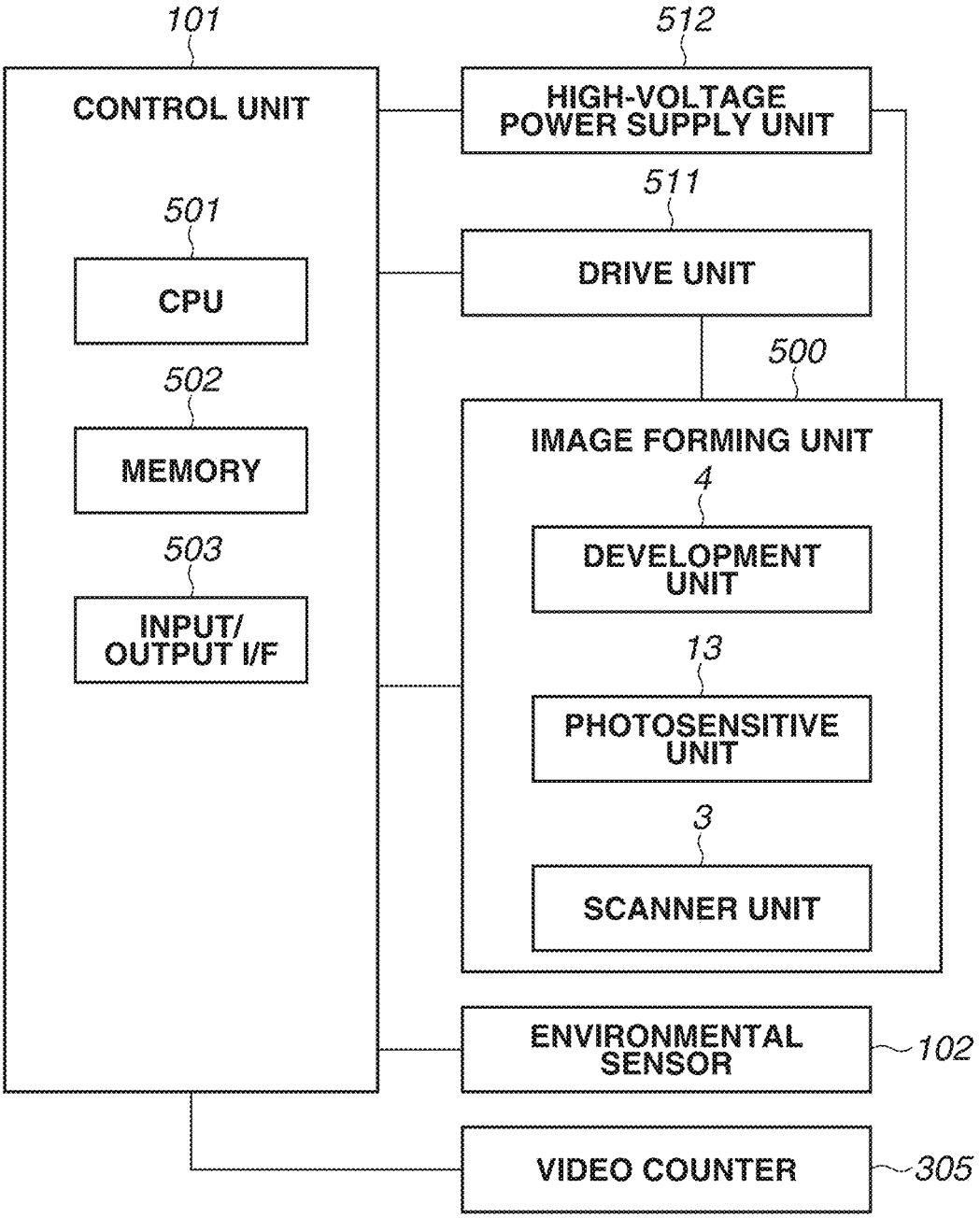
FIG. 11 is a block diagram illustrating control according to a fourth example embodiment.

The following describes a block diagram illustrating control according to the fourth example embodiment, with reference to FIG. 11. The control unit 101 includes a CPU 501 as a central element for performing calculation processing, a memory 502 such as a ROM and a RAM, and an input/output I/F 503 for inputting and outputting information from/to peripheral devices. The RAM stores a sensor detection result and an accumulation amount calculation result. The ROM stores control programs and data tables acquired in advance. The control unit 101 totally controls operations of the image forming apparatus 100. Control targets for the image forming apparatus 100 are connected to the control unit 101 via the input/output I/F 503. The control unit 101 controls transmission and reception of various electrical information signals and drive timing and manages jam detection and timing chart processing (described below).

The drive unit 511 refers to various motors and drive gears. The drive unit 511 collectively refers to power sources and power mechanisms for rotatably driving various rotary members included in the development units 4, the photosensitive units 13, and the scanner units 3, and operates based on control signals from the control unit 101. The high-voltage power source 512 collectively refers to power sources for applying high voltages to the charging rollers 2, the development rollers 17, the primary transfer rollers 8, the secondary transfer roller 9, and the fixing apparatus 34. The control unit 101 is connected with an environmental sensor 102, such as a temperature sensor, and therefore is capable of acquiring information about temperature, the amount of moisture in the air, and humidity based on detection signals from the environmental sensor 102. The control unit 101 is further connected with a video count measurement unit 305 for measuring a video signal output through an image forming operation.

The video count measurement unit 305 will be described in detail below. Another control apparatus (not illustrated) is disposed on the upstream side of the control unit 101. The control unit 101 branches a laser drive signal (video signal)

from the control apparatus and samples the video signal in the period for forming an electrostatic latent image on the photosensitive drum 1. The sampled video signal is input to a hardware counter in the control unit 101. The counter counts the number of ON states out of the ON/OFF states of the video signal, and the CPU 501 reads the count value. Then, by dividing the number of ON states of the video signal by the count value of the ON states measured when a black image is printed in the entire image print area on the recording material 12, the laser emission ratio for electrostatic latent image forming can be calculated. More specifically, the count value by the video count measurement unit 305 is equivalent to the number of ON states of the video signal for laser beam irradiation. The sampling period does not need to be synchronized with the video clock of the video signal. If sampling is to be performed at shorter intervals than the video clock, the video count measurement unit 305 may count pixel information asynchronously with the video clock. The CPU 501 included in the control unit 101 calculates the amount of toner accumulation in the toner charging brush 11 based on the measured video count value.

<Toner Charging Brush Discharge/Collection Process in Case of Large Amount of Accumulation>

According to the present example embodiment, in a case where a large amount of toner is collected at one time by the toner charging brush 11, the control unit 101 switches the discharge control. Examples of such cases include a case where an image with a high printing rate is continuously printed and a case where the entire toner on the intermediate transfer member needs to be collected because of a jam. More specifically, the control unit 101 increases the values of the positive and negative biases to be applied to the toner charging brush 11 and the number of repetitions of the bias application in the discharge process. This is because, even if the above-described control is performed, toner clogging occurs if the average printing rate is higher or if a jam occurs. If a jam occurs, in particular, a toner image before secondarily transferred remains on the intermediate transfer belt 5, and the toner for the image rushes into the toner charging brush 11 without being transferred onto the recording material 12. Accordingly, toner clogging occurs at deep portions of the toner charging brush 11 since the toner is pushed in by the following toner. To solve toner clogging which occurs at deep portions, it is necessary to increase the amplitudes of the positive and negative biases to be applied to more significantly vibrate the hair and increase the number of alternate bias applications to ensure the clogging resolution.

<Description of Toner Discharge Sequence>

According to the present example embodiment, immediately before and after the process for discharging toner from the toner charging brush 11 performed in the above-described non-image-forming period, a protection developer image is supplied from the development roller 17 to the photosensitive drum 1 to form a blocking layer, according to the amount of accumulation. The present example embodiment will be described below with reference to negatively charged toner.

Figure 12:
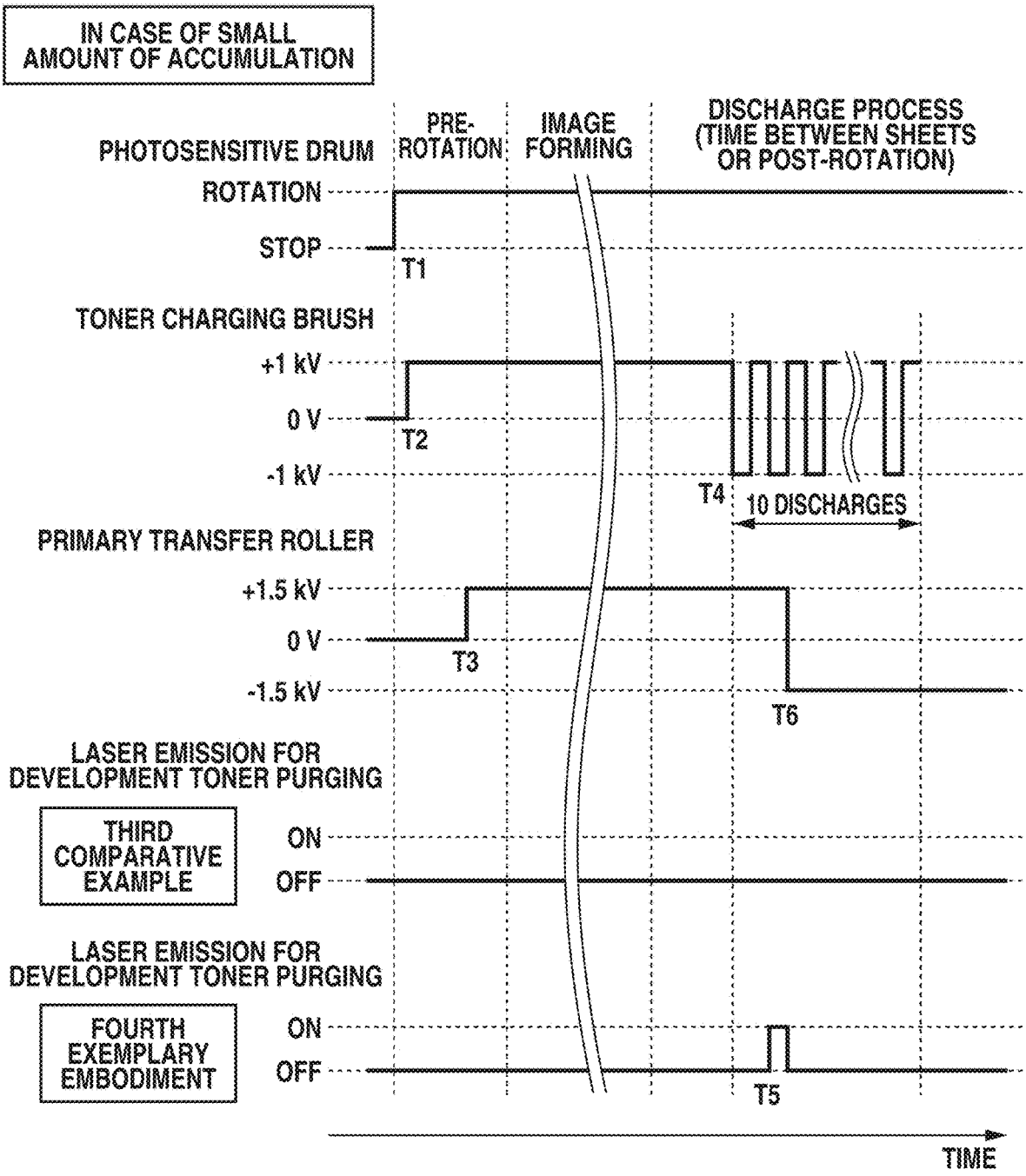
FIG. 12 is a timing chart illustrating a discharge process by the first image forming unit in a case of a small amount of accumulation.
Figure 13:
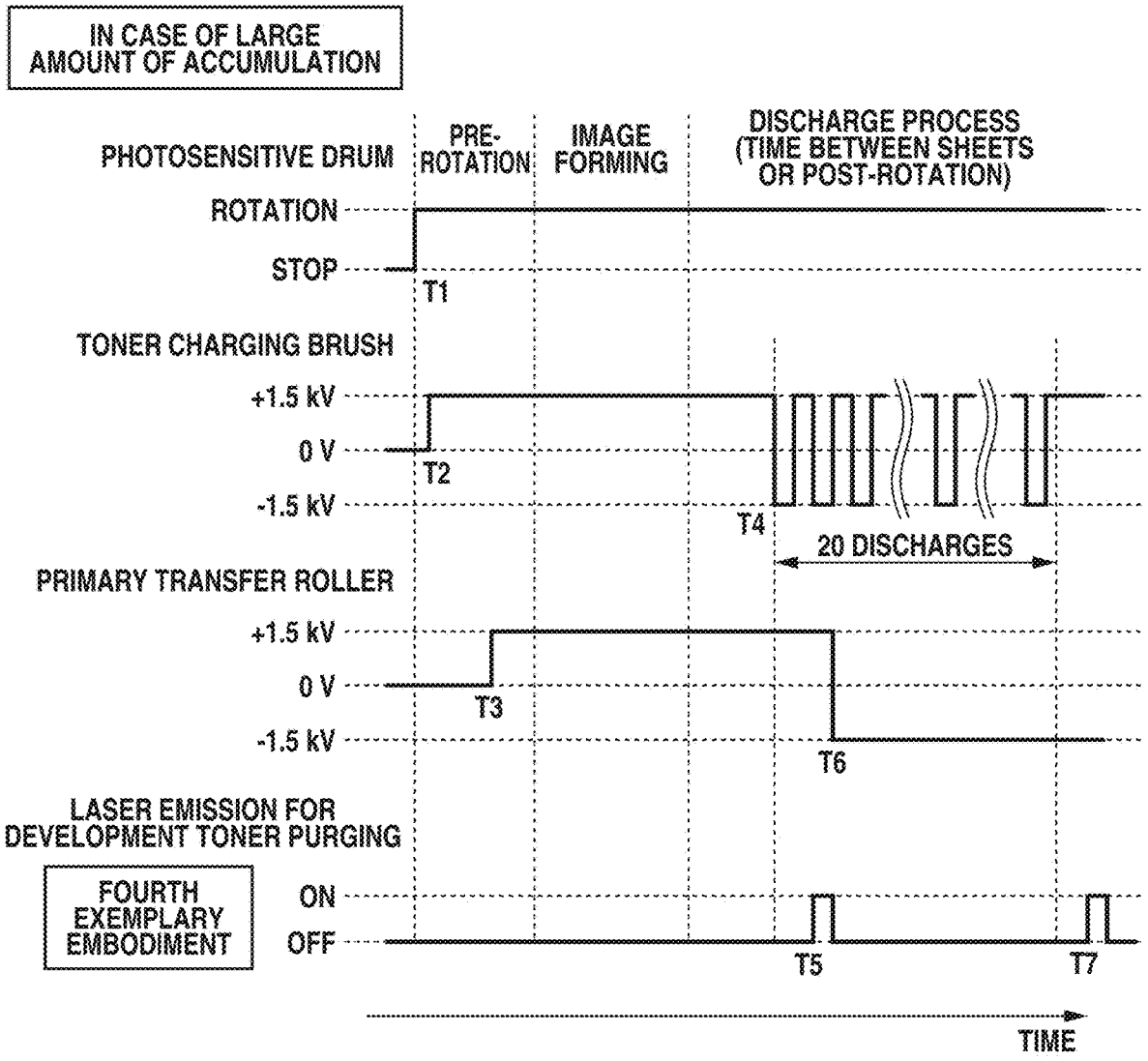
FIG. 13 is a timing chart illustrating the discharge process by the first image forming unit in a case of a large amount of accumulation.

FIGS. 12 and 13 are timing charts illustrating a case of a small amount of accumulation and a case of a large amount of accumulation, respectively. Each timing chart includes a timing of starting and stopping the rotation of the photosensitive drum 1, a timing of applying a positive bias and a negative bias to the toner charging brush 11 and the primary transfer roller 8, and a timing of laser emission for toner purging from the development roller 17 in the first image forming unit.

According to the present example embodiment, since the above-described amount of secondary residual transfer toner correlates with the printing rate, the control unit 101 counts the number of pixels for image forming based on the video count method to alternatively detect the amount of toner accumulation in the toner charging brush 11. This alternatively read values indicate the amount of secondary residual transfer toner and the amount of toner accumulation in the toner charging brush 11. Therefore, the value obtained by cumulatively adding this count value from the initial value since the printing operation is started serves as information which alternatively indicates the amount of accumulation.

The following describes a specific example of the calculation of the amount of accumulation by the control unit 101. Table 3 is used to calculate the amount of accumulation based on the video count value. Table data illustrated in Table 3 is stored in the above-described memory 502 illustrated in FIG. 11. The CPU 501 suitably refers to the table data to calculate the amount of accumulation.

Referring to Table 3, the second row indicates the printing rate calculated based on the video count value, assuming the A4 image size. For each page image, the CPU 501 calculates the printing rate and adds the printing rate to the current cumulative value. Assuming the total number of dots in the page image as a denominator and the number of ON states of the video signal counted in the page as a numerator, the CPU 501 multiplies the quotient by 100 to calculate the printing rate. The CPU 501 may sequentially decrement the calculated count-up value of the amount of accumulation, from the initial value.

The control unit 101 determines whether the incremented cumulative value of the amount of accumulation or the decremented cumulative value of the amount of accumulation exceeds a threshold value. When the control unit 101 determines that neither cumulative value exceeds the threshold value, the control unit 101 performs the timing chart illustrated FIG. 12. On the other hand, when the control unit 101 determines that either cumulative value exceeds the threshold value, the control unit 101 performs the timing chart illustrated in FIG. 13.

Actually, a table as illustrated in Table 3 is stored in the memory 502 for various image sizes. The CPU 501 refers to a table for the image size to be subjected to calculation for each page. The method for identifying the count-up value based on the video count value is not limited to the table-based form. The CPU 501 may calculate the count-up value according to a formula prestored in the memory 502. In addition, the CPU 501 may compare the incremented value or the decremented value of the video count value with a threshold value.

TABLE 3

Relation between accumulation count-up value and printing rate

| | Printing rate on A4 sheet calculated based on video count value | | | | | |
|---|---|---|---|---|---|---|
| | 0-2% | 2-5% | 5-10% | 10-20% | 20-50% | 50%- |
| Accumulation count-up value | 5 | 15 | 30 | 50 | 70 | 120 |

A third comparative example and the fourth example embodiment use a similar timing of starting the rotation of the photosensitive drum 1, and a similar timing of fluctuating the bias to be applied to the toner charging brush 11 and the primary transfer roller 8 in the process for discharging toner from the toner charging brush 11. In the discharge process, the biases applied to the development roller 17 and the charging roller 2 are similar to those in the image-forming period. In addition, the development roller 17 and the photosensitive drum 1 are continuously in contact with each other since the image-forming period. The following describes in detail the timing of the protection developer image forming according to the fourth example embodiment and the third comparative example.

<Timing Chart for Operations of First Image Forming Unit in Case of Small Amount of Accumulation>

The following describes a first control mode in the first image forming unit, with reference to FIG. 12. At the timing T1, the control unit 101 controls the drive unit 511 to start (turn on) the rotation of various rotary members. At the timing T2, the control unit 101 controls the high-voltage power source unit 512 to turn on the toner charging brush 11 to prepare for image forming. At the timing T3, the control unit 101 turns on the primary transfer roller 8. Although not illustrated, the charging roller 2, the development roller 17, the toner supply roller 18, the secondary transfer roller 9, and the fixing apparatus 10 start being applied with various biases by the corresponding high-voltage power sources.

Then, after completion of the image forming operation, the discharge process is started. The situation after completion of the image forming operation is equivalent to the time between page images (what is called the time between sheets) and the above-described post-rotation.

At the timing T4, the control unit 101 controls the high-voltage power source unit 512 to alternately apply a +1-kV bias and a −1-kV bias to the toner charging brush 11. More specifically, the control unit 101 performs toner discharge by alternately fluctuating the bias between +1 and −1 kV 10 times at 0.2-second intervals. Thus, developer (first developer) discharged from the toner charging brush 11 is moved to the intermediate transfer belt 5.

At the timing T5, the control unit 101 controls the scanner unit 3 to perform the laser emission for the protection developer image. This laser emission forms an electrostatic latent image for the protection developer image on the photosensitive drum 1. Then, before the developer reversely transferred is supplied to the above-described cleaning blade 6, developer (second developer) is supplied from the development roller 17 (developer bearing member) to the cleaning blade 6. The protection developer image according to the present example embodiment is what is called a 1-dot one space image in which a solid black horizontal line image with a 1-dot width (about 0.042 mm) and a blank image with a 1-dot width are alternately repeated in the entire image forming area in the rotational axis direction of the photosensitive drum 1.

According to the third comparative example, the development roller 17 and the photosensitive drum 1 are only in contact with each other without the protection developer image in the discharge process. The control unit 101 performs the laser emission for forming a toner image (hereinafter referred to as a protection developer image) for supplying toner from the development roller 17 to the cleaning blade 6 of the photosensitive drum 1 in a case of a small amount of accumulation (FIG. 12) in fourth example embodiment. However, the control unit 101 does not perform this laser emission in the third comparative example.

At the timing T6, the control unit 101 controls the high-voltage power source unit 512 to apply a negative bias to the primary transfer roller 8Y. Referring to FIG. 13, when the protection developer image formed at the timing T5 passes the transfer portion formed by the primary transfer roller 8Y and the intermediate transfer belt 5, a negative reverse bias (having a polarity that is the same as the normal charging polarity of the developer) is applied to the primary transfer roller 8Y. However, the present disclosure is not limited thereto. It is confirmed that, even if the transfer bias applied to the primary transfer roller 8Y is turned off or if a transfer bias having a small positive value is applied to the primary transfer roller 8Y, a fixed amount of the protection developer is supplied to the cleaning blade 6. The processing performed at the timings T1 to T6 excluding the timing T5 is common to the fourth example embodiment and the third comparative example.

Figure 14:
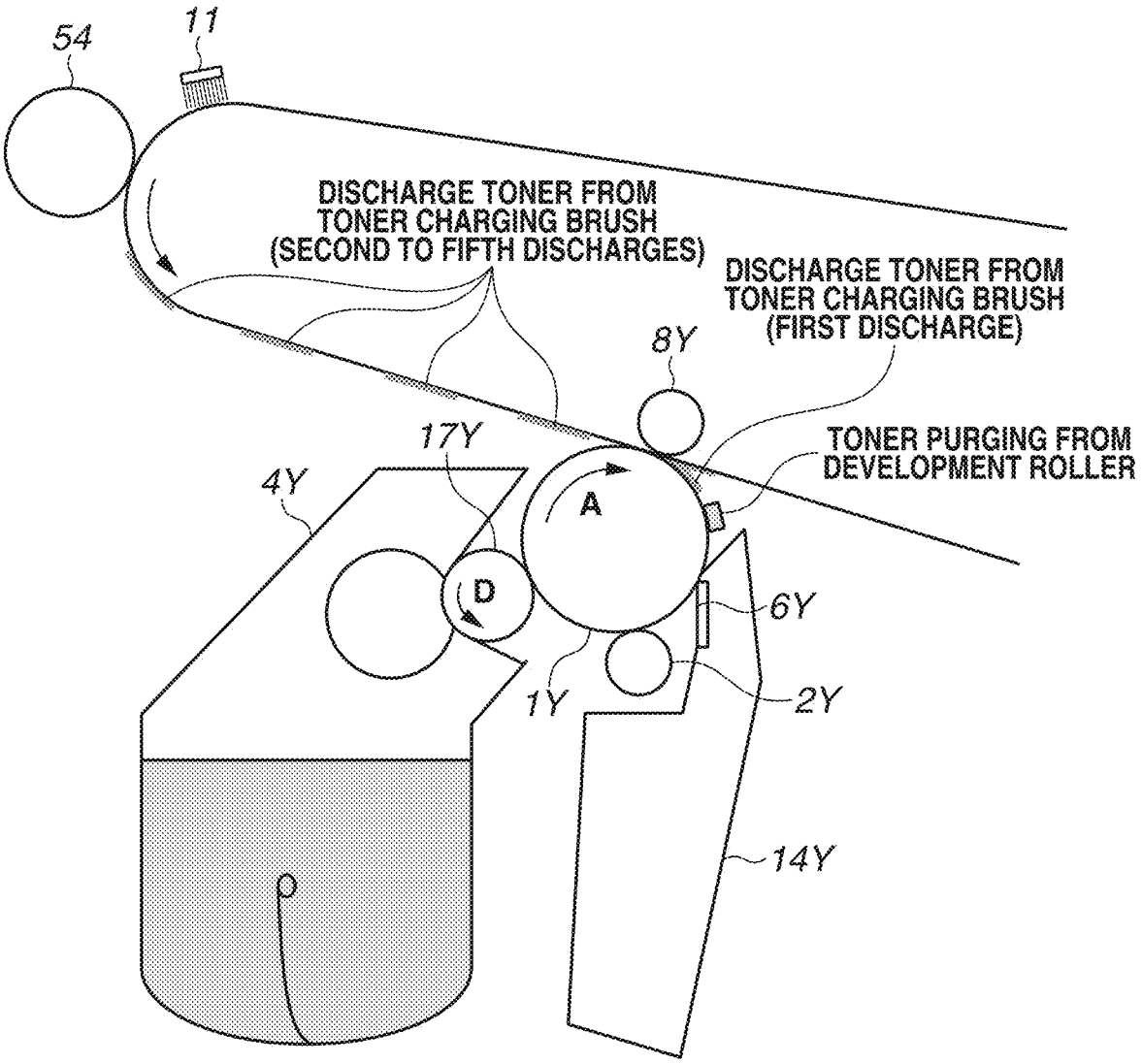
FIG. 14 is a cross-sectional view illustrating an image forming apparatus for describing a bias application timing for a toner charging brush, a primary transfer roller, and a development roller according to the fourth example embodiment.

The following describes relations between the timings T4 to T6, with reference to FIG. 14. As illustrated in FIG. 14, according to the present fourth example embodiment and the fourth comparative example, toner for the protection developer image comes on the downstream side of the first discharge toner from the toner charging brush 11, on the photosensitive drum 1Y. The process speed (the rotational speed of the photosensitive drum 1 and the intermediate transfer belt 5) according to the present fourth example embodiment is 200 mm/s.

Referring to the positional relation between members, a distance L1 from the toner charging brush 11 to the position where the photosensitive drum 1Y of the first image forming unit contacts the intermediate transfer belt 5 is 150 mm. A distance L2 from the position of laser irradiation on the photosensitive drum 1Y by the scanner unit 3 to the position where the photosensitive drum 1Y contacts the intermediate transfer belt 5 is 50 mm.

In this configuration according to the present fourth example embodiment, with reference to the timing when the toner charging brush 11 starts being applied with a discharge bias (−1 kV), the discharge toner from the toner charging brush 11 reaches the position where the photosensitive drum 1Y contacts the intermediate transfer belt 5, in 0.75 seconds. To supply the protection developer image to the cleaning blade 6 before this timing, the scanner unit 3 performs the laser emission for the protection developer image at 0.4 seconds after the toner charging brush 11 is applied with the discharge bias. The developed protection developer image reaches the position (contact portion) where the photosensitive drum 1Y contacts the intermediate transfer belt 5, in 0.65 seconds. To collect (reversely transfer) the negative discharge toner from the toner charging brush 11 onto the photosensitive drum 1, the control unit 101 applies a negative bias to the primary transfer roller 8Y to prevent the negative toner of the protection developer image from being transferred onto the intermediate transfer belt 5. For specific example, the control unit 101 changes the bias to the primary transfer roller 8Y to −1.5 kV at 0.5 seconds after the toner charging brush 11 is applied with the discharge bias (timing T6). The control unit 101 performs the above-described control to supply the toner for the protection developer image before collecting the discharge toner from the toner charging brush 11 to the cleaning blade 6Y in the first image forming unit. This means that, after forming a blocking layer at the edge portion of the cleaning blade 6, the discharge toner from the toner charging brush 11 is collected by the photosensitive drum 1, making it possible to prevent faulty cleaning at the discharge timing. In addition, the time period in seconds since the time when the toner charging brush 11 is applied with the discharge bias till the time when the scanner unit 3 performs the laser emission for the protection developer image is suitably determined by the distance L2 and the diameter of and the photosensitive drum 1.

<Timing Chart for Operations of First Image Forming Unit in Case of Large Amount of Accumulation>

The following describes a second control mode with reference to FIG. 13. In the second control mode, a larger amount of the developer (first developer) or the developer having a larger charge amount than in the first control mode (FIG. 12) is supplied from the toner charging brush 11 to the cleaning blade 6. In addition, when the second control mode is performed, a larger amount of the developer (second developer) is supplied from the development roller 17 to the cleaning blade 6. The control unit 101 performs the second control mode in a selective way with the first control mode according to the amount of accumulation identified in the above-described video count processing. More specifically, if the incremented or decremented value of the amount of accumulation exceeds a threshold value, the control unit 101 performs the timing chart illustrated in FIG. 13. This relation also applies to the timing charts illustrated in FIGS. 15 and 16 (described below).

The timings T1 to T6 are basically similar to the timings T1 to T6 illustrated in FIG. 12, and detailed descriptions thereof will be omitted. However, the number of repetitions of the bias application performed at the timing T4 differs from that illustrated in FIG. 12. According to the inventor's consideration, it turned out that, even in a case of a large amount of accumulation, clogged toner at deep positions can also be resolved by increasing the absolute value of the amplitudes of the biases to be applied and increasing the number of repetitions of the positive/negative bias application to vibrate the hair to at deeper portions. According to the present example embodiment, toner clogging can be restrained by increasing the amplitude absolute value of the positive/negative bias to ±1.5 kV and increasing the number of repetitions of the bias application to 20. More specifically, by increasing the amplitude absolute value of the positive/negative bias and increasing the number of repetitions of the bias application, a large amount of the developer or the developer having a large charge amount can be discharged from the toner charging brush 11. In power source control, performing one bias application refers to applying a pair of negative and positive biases.

At the timing T7, the toner discharged from the toner charging brush 11 is collected by the cleaning blade 6. Then, the control unit 101 controls the scanner unit 3 to perform the laser emission for the protection developer image subsequent to the laser emission for the protection developer image at the timing T5. In the processing at the timing T7, the developer (second developer) from the development roller 17 is intermittently supplied to the cleaning blade 6 a plurality of times, making it possible to maintain the protection of the blocking layer.

Although the number of alternate bias applications only needs to be constantly increased in order to simply resolve the clogged toner in the toner charging brush 11, the productivity will be degraded. On the other hand, according to the present example embodiment, the control unit 101 switches between the timing charts illustrated in FIGS. 12 and 13 depending on whether the incremented or decremented amount of toner accumulation in the toner charging brush 11 exceeds a threshold value. This enables restricting the increase in down time as much as possible.

As illustrated in the timing chart in FIG. 13, to resolve the clogged toner in the toner charging brush 11, it is effective to increase the amplitude of the alternate bias application. However, there arises another problem of an increase in the charge amount and the amount of the toner discharged onto the intermediate transfer member. There has been a case where, even if toner having a comparatively lower charge amount than the reverse transfer toner is supplied from the development apparatus to the cleaning blade before the reverse transfer toner rushes into the cleaning blade, the effect of the blocking layer destruction by the reverse transfer toner increases to generate vertical streaks. Constantly increasing the amount of toner sent from the development apparatus increases the effect of restricting vertical streaks but decreases the amount of toner usable for image forming. On the other hand, the above-described example embodiment increases the amount of toner to be suppled to reinforce the blocking layer only when necessary, making it possible to prevent toner from being wasted for other than image forming as much as possible.

The following describes the timing when the second image forming unit forms a protection developer image. The second image forming unit is disposed on the downstream side of the first image forming unit in the moving direction of the intermediate transfer belt 5.

The second image forming unit mainly collects positive toner that has not completely been collected in the first image forming unit out of the discharge toner from the toner charging brush 11. At this timing, like the case of the first image forming unit, the control unit 101 perform control such that the protection developer image comes on the downstream side of the first discharge toner from the toner charging brush 11 on the photosensitive drum 1M as the second image bearing member. The protection developer image is supplied from the development roller 17M as a second developer bearing member. The protection developer image is negative toner, and positive discharge toner is to be collected from the toner charging brush 11. Therefore, the bias applied to the primary transfer roller 8M (second transfer member) differs from the bias in the first image forming unit.

<Timing Chart for Operations of Second Image Forming Unit in Case of Small Amount of Accumulation>

Figure 15:
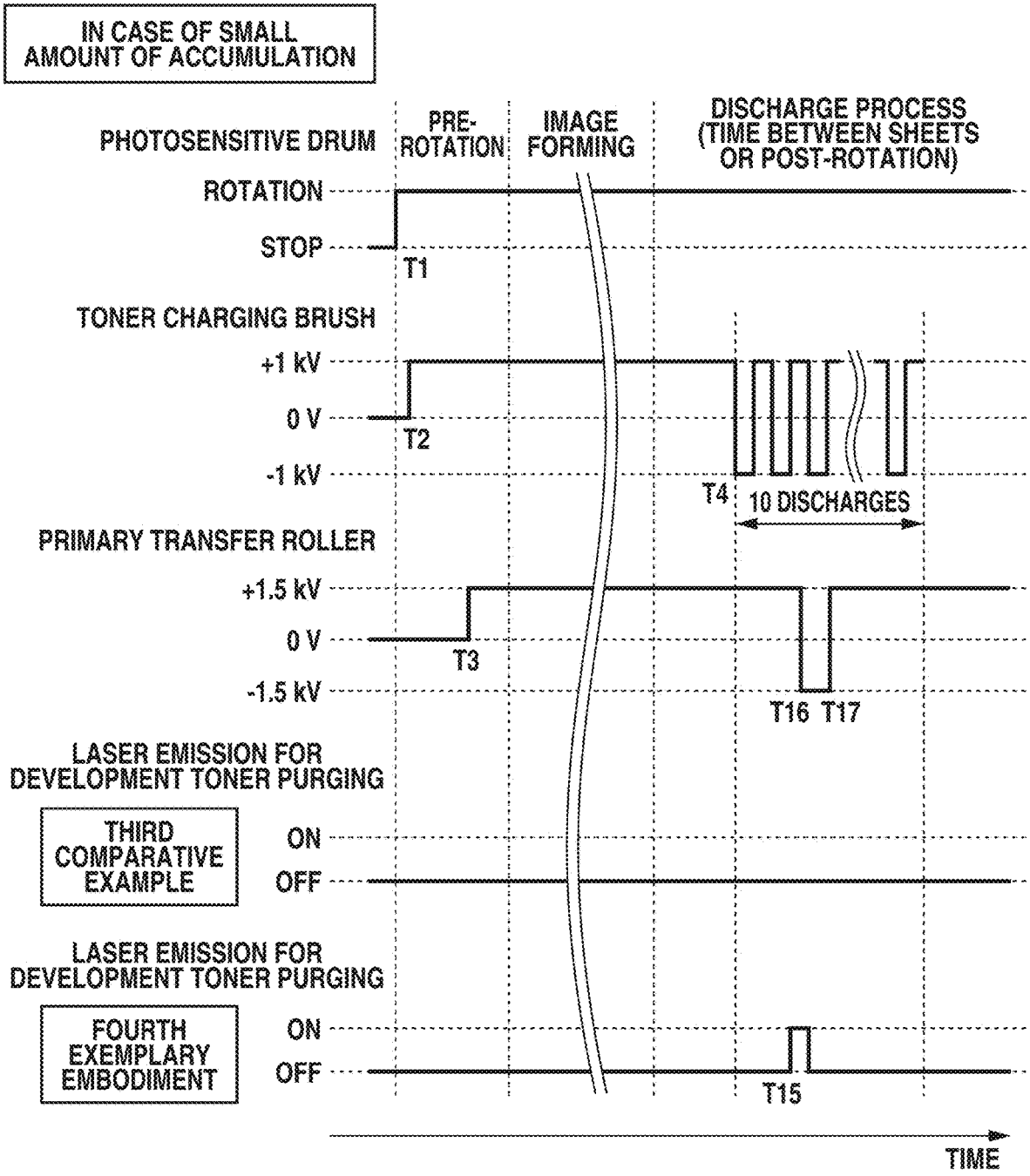
FIG. 15 is a timing chart illustrating a discharge process by the second image forming unit in a case of a small amount of accumulation.

The following describes the second image forming unit with reference to FIG. 15. Processing at the timings T1 to T4 is similar to the processing in the first image forming unit, and detailed descriptions thereof will be omitted. In the second image forming unit, a distance L12 from the toner charging brush 11 to the position (second transfer portion) where the photosensitive drum 1M of the second image forming unit contacts the intermediate transfer belt 5 is 250 mm. The distance L12 is 100 mm longer than the distance L1. Under the control of the control unit 101, the toner discharged from the toner charging brush 11 at the timing T4 reaches the position (transfer nip) where the photosensitive drum 1M contacts the intermediate transfer belt 5, in 1.25 seconds. With reference to the timing when the toner charging brush 11 is applied with the discharge bias, the control unit 101 performs the laser emission for the protection developer image (fourth developer) in 0.8 seconds (timing T15), and the discharge toner reaches the position where the photosensitive drum 1M contacts the intermediate transfer belt 5, in 1.05 seconds. At this timing, to prevent the negative toner for the protection developer image from being transferred onto the intermediate transfer belt 5, the control unit 101 changes the bias of the primary transfer roller 8M to −1.5 kV at 0.95 seconds after the toner charging brush 11 is applied with the discharge bias (timing T16). In the third comparative example, the laser emission for the protection developer image is not performed.

To collect the positive discharge toner from the toner charging brush 11 onto the photosensitive drum 1M, the control unit 101 changes the bias of the primary transfer roller 8M to +1.5 kV at 1.15 seconds after the toner charging brush 11 is applied with the discharge bias (timing T17). The timing when a part of the protection developer image (second developer) reversely untransferred in the first image forming unit reaches the second transfer portion formed by the primary transfer roller 8M and the intermediate transfer belt 5 is referred to as a first timing. The timing when the protection developer image (fourth developer) in the second image forming unit reaches the second previous transfer portion is referred to as a second timing. The first timing differs from the second timing. When the first and the second timings are matched, untransferred toner having a higher density reaches the secondary transfer portion, causing a problem of stain at the secondary transfer portion.

<Timing Chart for Operations of Second Image Forming Unit in Case of Large Amount of Accumulation>

Figure 16:
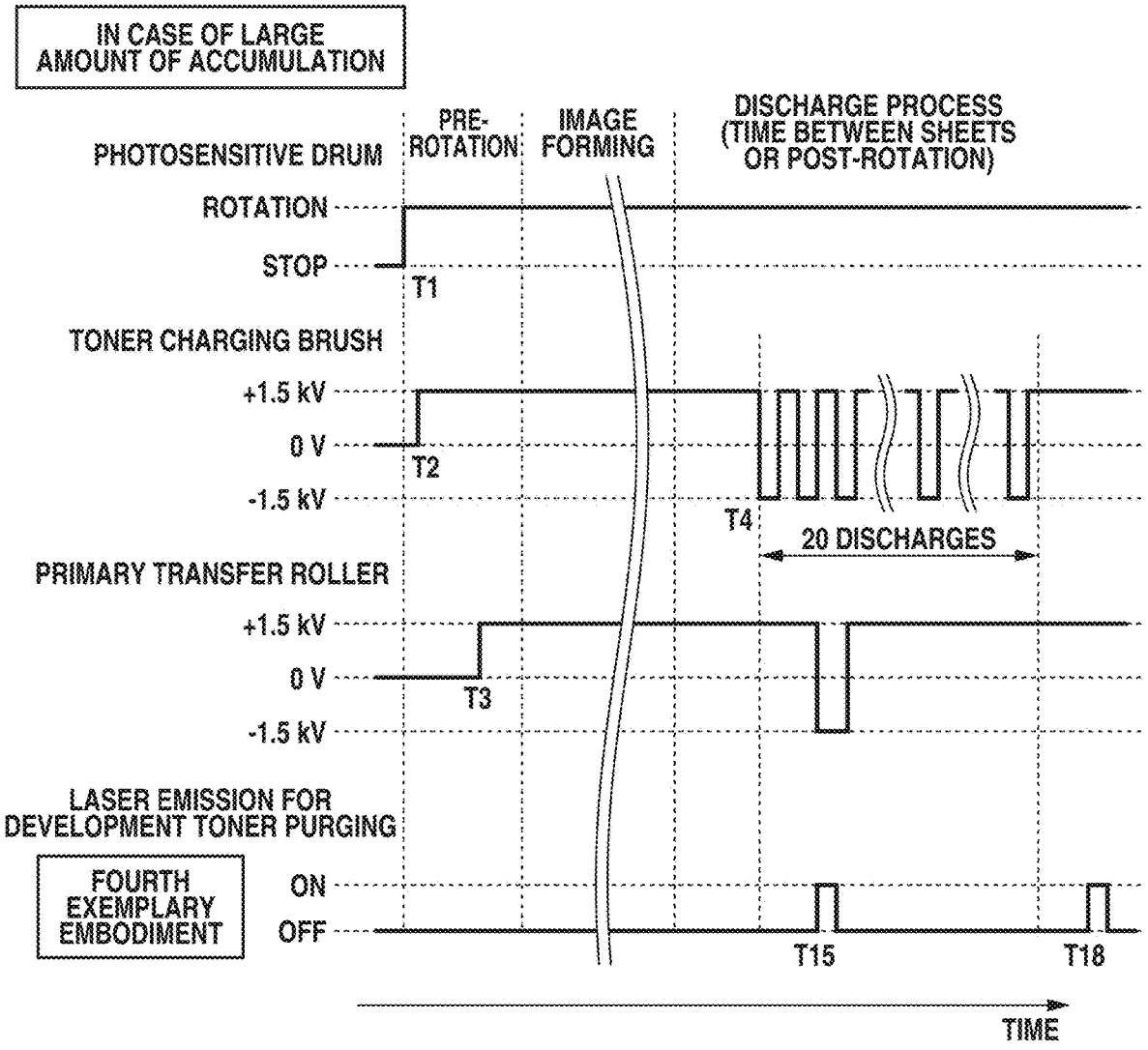
FIG. 16 is a timing chart illustrating the discharge process by the second image forming unit in a case of a large amount of accumulation.

The following describes the second image forming unit with reference to FIG. 16. Processing at the timings T15 to T17 is similar to the processing in the first image forming unit, and detailed descriptions thereof will be omitted. In the timing chart illustrated in FIG. 16, at the timing T18, the control unit 101 controls the scanner unit 3 to perform the laser emission for the protection developer image again, like the timing T15. Referring to the timing chart illustrated in FIG. 16, it has been confirmed that an effect similar to the one illustrated in FIG. 13 can be obtained. By performing the processing at the timing T18, the developer (second developer) from the development roller 17 is intermittently supplied to the cleaning blade 6 a plurality of times, making it possible to maintain the protection of the blocking layer.

The control unit 101 controls the third image forming unit, like the above-described second image forming unit, such that the protection developer image is collected by the cleaning blade 6C before the discharge toner from the toner charging brush 11 is collected. The control unit 101 controls the fourth image forming unit, like the above-described first image forming unit, such that the protection developer image is collected by the cleaning blade 6K before the discharge toner from the toner charging brush 11 is collected.

Comparative Example 3

In the third comparative example, at the timing T4, the high-voltage power source unit 512 starts the alternate bias application to the toner charging brush 11 10 times regardless of the amount of toner accumulation. More specifically, regardless of the amount of toner accumulated in the toner charging brush 11, the number of alternate bias applications to the toner charging brush 11 is constant. The scanner unit 3 does not perform the laser emission for the protection developer image which is performed at the timing T5 in the timing chart illustrated in FIG. 13.

<Verification Results>

The following describes the comparison of the cleaning performance when the discharge process is actually performed under the conditions according to the fourth example embodiment and the third comparative example. In the sequences illustrated in FIGS. 13 and 14, the number of discharges is changed according to the incremented or decremented value of the amount of accumulation. When the number of discharges is increased, the number of times of development purging is increased. As a printing condition, an A4-size image was printed on the same number of sheets for each of 2%, 5%, 10%, 15%, and 25% printing rates. For example, in the case of printing on 3,000 sheets, printing is performed on 600 sheets for each of the printing rates. As a result, the following table was obtained. The amount of the protection developer image sent before collecting the toner discharged from the toner charging brush 11 (hereinafter referred to as discharge toner) corresponds to toner purging for a total of 40 dots.

TABLE 4

Vertical streak generation status after printing on predetermined number of sheets

| | Vertical streak generation level | | |
|---|---|---|---|
| | Initial state | 3,000 sheets | 6,000 sheets |
| Fourth example embodiment | ○ | ○ | ○ |
| Third comparative example | ○ | x | x |

Table 4 illustrates a vertical streak image generation status after printing is performed on a predetermined number of sheets. o indicates that no vertical streak image was generated, and x indicates five or more vertical streaks were generated. In the third comparative example, vertical streaks due to faulty cleaning were generated. After 3,000-sheet passing, a large number of vertical streaks were generated. In the configuration according to the fourth example embodiment, no vertical streak image is generated. This is because the cleaning performance is improved for the following reason. When the protection developer image is supplied before and after the discharge toner collection, the external additive (additive particles) moves to the photosensitive drum 1, and a blocking layer having a role of a barrier layer is formed at the edge portion of the cleaning blade 6.

Figure 17:
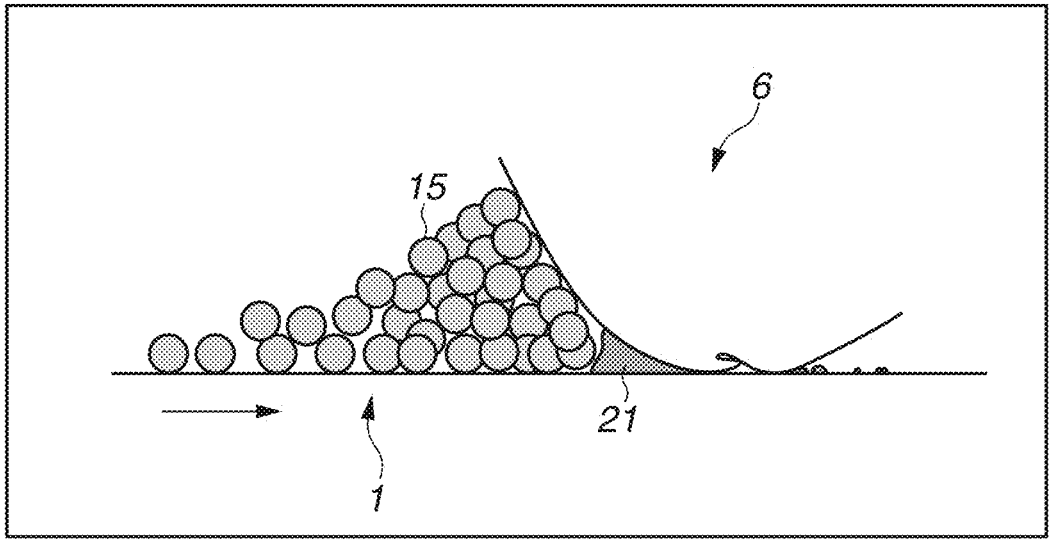
FIG. 17 is an enlarged view illustrating a relation between the edge portion of the cleaning blade 6 and the blocking layer.

The following describes a mechanism for improving the cleaning performance for the protection developer image at the timing T5, with reference to the enlarged view of the edge portion of the cleaning blade 6 illustrated in FIG. 17. As illustrated in FIG. 17, the cleaning blade 6 contacts the photosensitive drum 1 in the counter-rotational direction of the photosensitive drum 1, i.e., the edge portion of the cleaning blade 6 is rolled by the rotation of the photosensitive drum 1. The toner external additive moved to the photosensitive drum 1 accumulates in the wedge-like portion where the edge portion of the cleaning blade 6 is rolled, to form a layer (hereinafter this layer is referred to as a blocking layer 21). If toner is cleaned without the blocking layer 21, toner is likely to get in from the wedge-like portion where the edge portion of the cleaning blade 6 is rolled, inducing faulty cleaning. If the blocking layer 21 exists at the edge portion of the cleaning blade 6 (contact portion) as illustrated in FIG. 16, toner does not get in, improving the cleaning performance. Meanwhile, since the blocking layer 21 is formed of toner external additive with a diameter of about 20 nm, a fixed amount of external additive is constantly fallen out from the edge portion of the cleaning blade 6. Toner discharged from the toner charging brush 11 in the discharge process is applied with toner charge of −65 to −100 μC/g by the bias of the toner charging brush 11. The charge amount of the toner held by the development roller 17 is about −30 μC/g. With the increase in toner charge, the adhesion to the photosensitive drum 1 increases, making the toner more likely to inroad into the blocking layer 21 with the rotation of the photosensitive drum 1 and to destroy the blocking layer 21. Since the discharge toner from the toner charging brush 11 is likely to cause faulty cleaning, a sufficient blocking layer 21 needed to be formed before the discharge toner collection. Therefore, according to the present example embodiment, immediately before the discharge toner collection, a protection developer image is formed on the photosensitive drum 1 in order to form a sufficient amount of the blocking layer 21.

Figure 18:
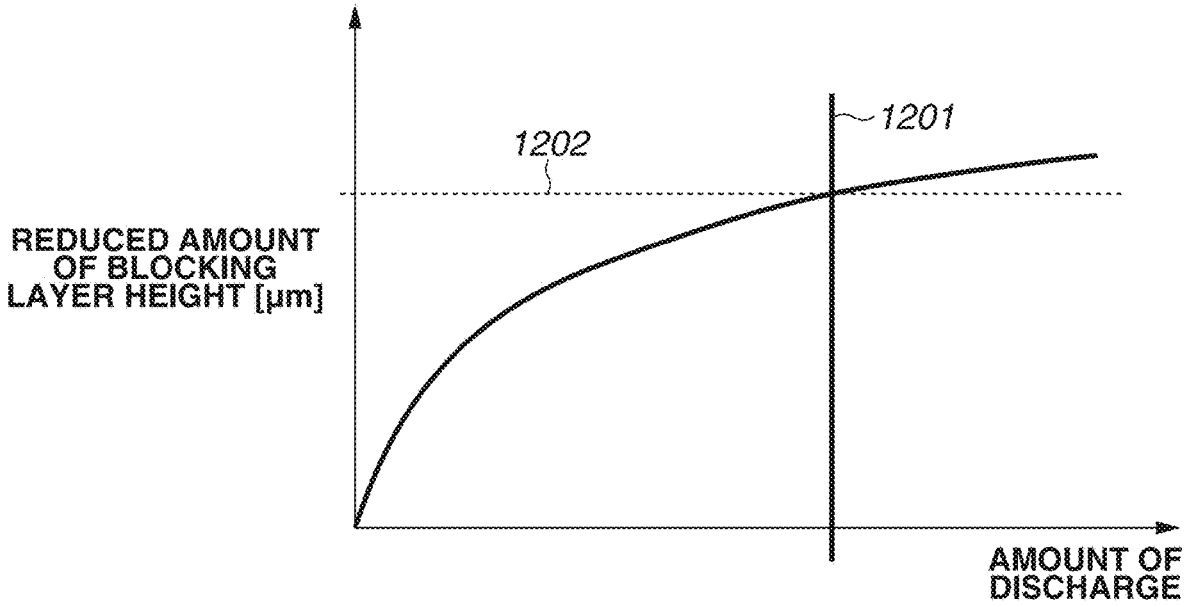
FIG. 18 illustrates a relation between an amount of discharge toner and the reduced amount of the blocking layer height.

FIG. 18 illustrates a relation between the amount of the toner discharged from the toner charging brush 11 and the reduced amount of the blocking layer 21. The horizontal axis is assigned the amount of the toner discharged from the toner charging brush 11, and the vertical axis is assigned the reduced amount of the blocking layer 21. A thick vertical solid line 1201 denotes a criterion of the discharge amount with which vertical streaks are generated in a case where the blocking layer 21 is reinforced once at the timing T5 or T15 by using the protection developer image before the discharge toner collection. A horizontal dotted line 1202 denotes a criterion of the reduced amount of the blocking layer 21 when vertical streaks are generated. In other words, if further reduction of the blocking layer 21 occurs, the blocking layer reduction exceeding the blocking layer reinforcement occurs, possibly resulting in the generation of vertical streaks due to blocking layer destruction. A measure for further reinforcing the blocking layer 21 is required.

With the increase in the number of sheets that pass, the amount of the toner discharged from the toner charging brush 11 increases to increase the absolute value of charges. The reason why the amount of toner increases is that the increase in the cumulative value of the amount of the secondary residual transfer toner increases the amount of accumulation. A possible reason why the absolute value of charges increases is that the discharge toner is subjected to repetitive electric discharge during image forming. For this reason, the reduced amount of the blocking layer 21 increases with increasing number of sheets that pass (increasing amount of discharge toner). Therefore, according to the third comparative example in which the blocking layer 21 is not reinforced by the protection developer image, a vertical streak image was generated under the condition after 3,000-sheet passing.

<Contact/Separation Timing Chart for Photosensitive Drum 1 of Development Roller 17>

Figure 19:
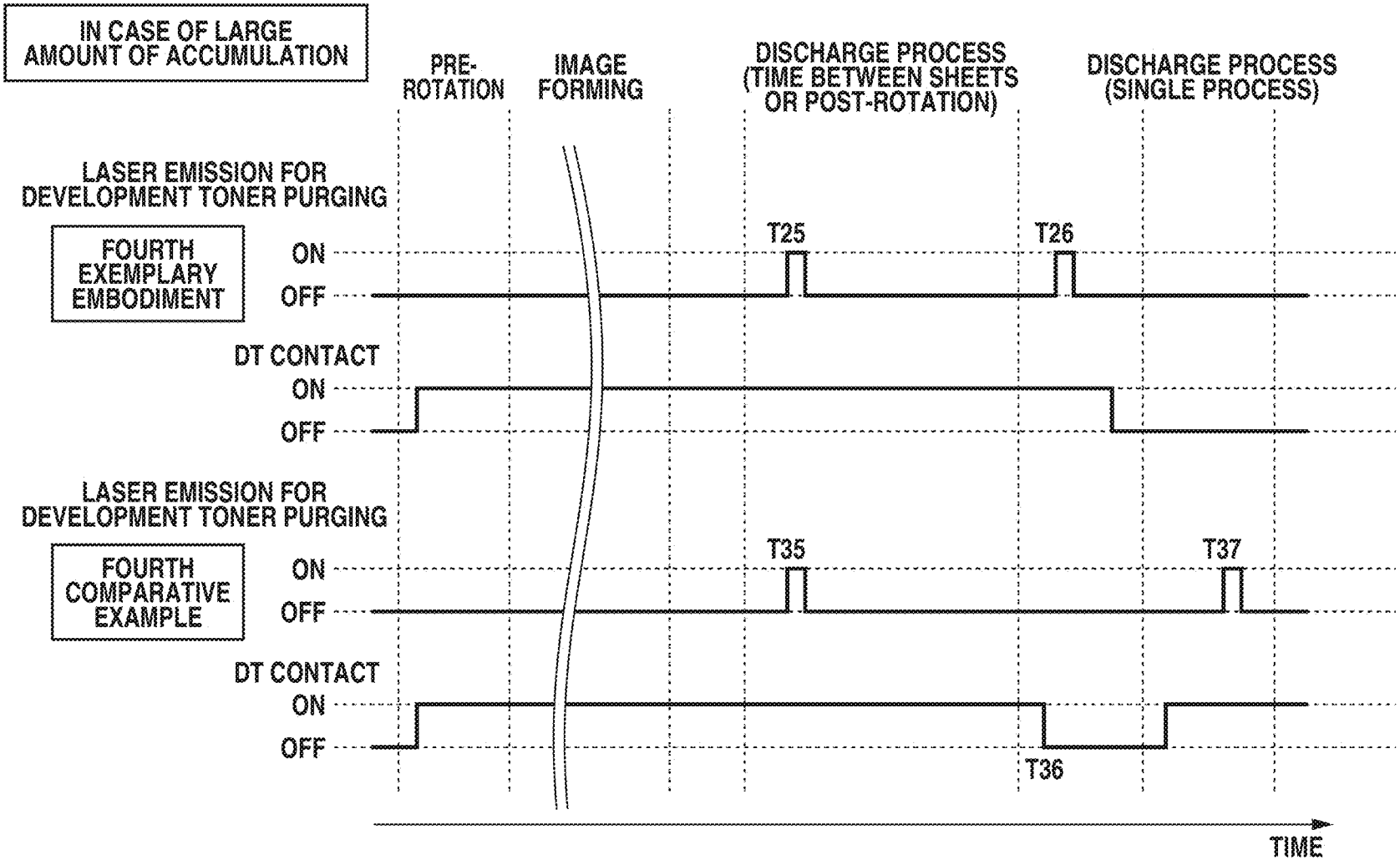
FIG. 19 is a timing chart illustrating laser emission for a protection developer image and a contact operation of a development unit according to the fourth example embodiment and a third comparative example.

The basic configuration is similar to the basic configuration described above. After the post-rotation, the control unit 101 forms a protection developer image after the discharge toner collection, as single control. If the blocking layer 21 is reinforced by using the protection developer image after the discharge toner collection, the improvement in productivity can be expected depending on the implementation timing. FIG. 19 is a timing chart illustrating laser emission for the protection developer image and a contact operation of the development unit 4. Processing is performed based on control instructions of the control unit 101.

According to the present example embodiment, the implementation timing is the post-rotation process. On the other hand, according to the fourth comparative example, the protection developer image is sent as single control after the post-rotation. The fourth comparative example includes a contact/separation operation for the development unit 4, resulting in a degraded productivity. According to the present example embodiment, when a plurality of protection developers needs to be supplied, laser emission is continuously performed at the timing T25 and T26 without separating the photosensitive drum 1 and the development roller 17. For this reason, the processing time prolongs by only 3 seconds or around as compared with the fourth comparative example. More specifically, an operation for separating the development roller 17 and the photosensitive drum 1 is performed after completion of the developer supply from the development roller 17. On the other hand, according to the fourth comparative example, a separation/contact operation for the photosensitive drum 1 and the development roller 17 is performed at the timing T36 between the timing T36 and the laser emission timing T37. The processing time prolongs by 10 seconds or around, resulting in a degraded productivity.

When image confirmation was performed after 6,000-sheet passing under the above-described conditions, abnormal sound was generated in the fourth comparative example. It turned out that abnormal sound was generated for the following reason. When the sliding resistance between the cleaning blade 6 and the photosensitive drum 1 increased, chattering was generated from the cleaning blade 6, and a vibration was amplified when transmitted to the photosensitive drum 1. Abnormal sound was generated while the photosensitive drum 1 was driven in the separated state of the development unit 4. It turned out that abnormal sound is not generated in the contact state of the development unit 4 for the following reason. While the development roller 17 contacts the photosensitive drum 1, the vibration of the photosensitive drum 1 can be restricted, and therefore a vibration does not occur to such an extent as to generate abnormal sound. The sliding resistance increased because the blocking layer 21 decreased after the discharge toner collection. The sliding resistance is determined by the number of lubricative particles existing between the photosensitive drum 1 and the cleaning blade 6. Since particles forming the blocking layer 21 are lubricative, the reduction of the blocking layer 21 illustrated in FIG. 17 increases the contact area between the photosensitive drum 1 and the cleaning blade 6, resulting in the increased sliding resistance. According to the fourth example embodiment, the destroyed blocking layer 21 is reinforced by sending the protection developer image before the separation of the development unit 4. Therefore, the sliding resistance does not increase, and abnormal sound was not generated.

The basic configuration and control of the image forming apparatus according to the fifth example embodiment are similar to those according to the fourth example embodiment, and detailed descriptions thereof will be omitted. The following describes the discharge/collection process for the toner charging brush 11 according to the fifth example embodiment.

<Discharge/Collection Process for Toner Charging Brush>

According to fifth example embodiment, like the fourth example embodiment, when discharge control for the toner charging brush 11 is performed a plurality of times according to situation, the control of the protection developer image is also accordingly changed.

Table 5 illustrates a relation between the number of repetitions of the positive/negative bias application and the amplitudes of the applied biases at the discharge timing according to the fifth example embodiment. For convenience, control modes are collectively referred to as modes A to D. The control unit 101 selectively performs each control mode according to the amount of accumulation identified by the video count processing according to the fourth example embodiment. More specifically, table data illustrated in Table 6 is prestored in the memory 502. The control unit 101 selects any one mode according to the amount of accumulation according to the fourth example embodiment. For example, when the mode C is selected by the control unit 101, the power source control illustrated in Table 6 is performed at the timing T4 in the timing charts illustrated in FIGS. 12, 13, 15, and 16.

In this way, the control unit 101 selects the mode to be implemented according to the amount of accumulation during execution of discharge control. Although a sufficient amount of toner can be discharged by increasing the number of repetitions of the bias application, the productivity will be degraded. Therefore, the productivity degradation can be minimized by increasing the number of repetitions of the bias application with increasing amount of accumulation.

TABLE 5

Relation between number of repetitions and amplitude of positive/negative bias to be applied

| | Number of repetitions | Positive/negative applied bias |
|---|---|---|
| A | 5 | ±1.0 kV |
| B | 10 | ±1.0 kV |
| C | 15 | ±1.0 kV |
| D | 20 | ±1.5 kV |

Figure 20:
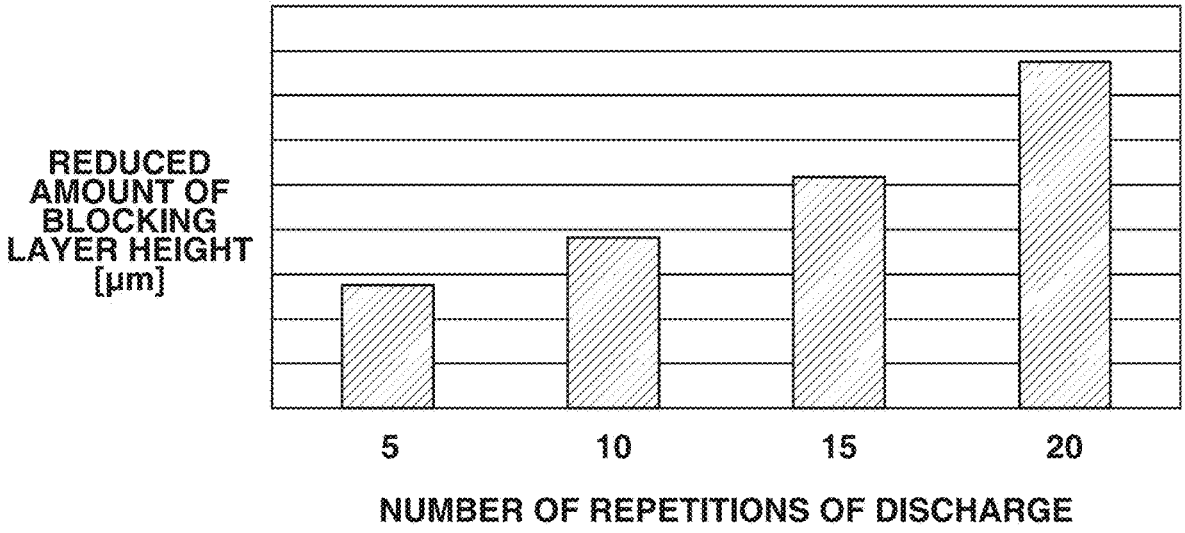
FIG. 20 illustrates a reduced amount of a blocking layer height under control A to D according to a fifth example embodiment.

FIG. 20 illustrates the reduced amount of the blocking layer height when discharge control is performed in the modes A to D. The vertical axis is assigned the reduced amount of the blocking layer height, and the horizontal axis is assigned the number of repetitions of discharge control. For example, if the number of repetitions at the timing T4 illustrated in FIG. 13 increases, the reduced amount of the blocking layer height increases. In the mode D, it turns out that the increase in the reduced amount of the blocking layer 21 is larger than the proportional increase in the number of repetitions. Since the applied bias at the discharge timing is strong, the amount of toner clogged in deeper portions increases to increase the amount of current flow, thus increasing the charge amount.

Figure 21:
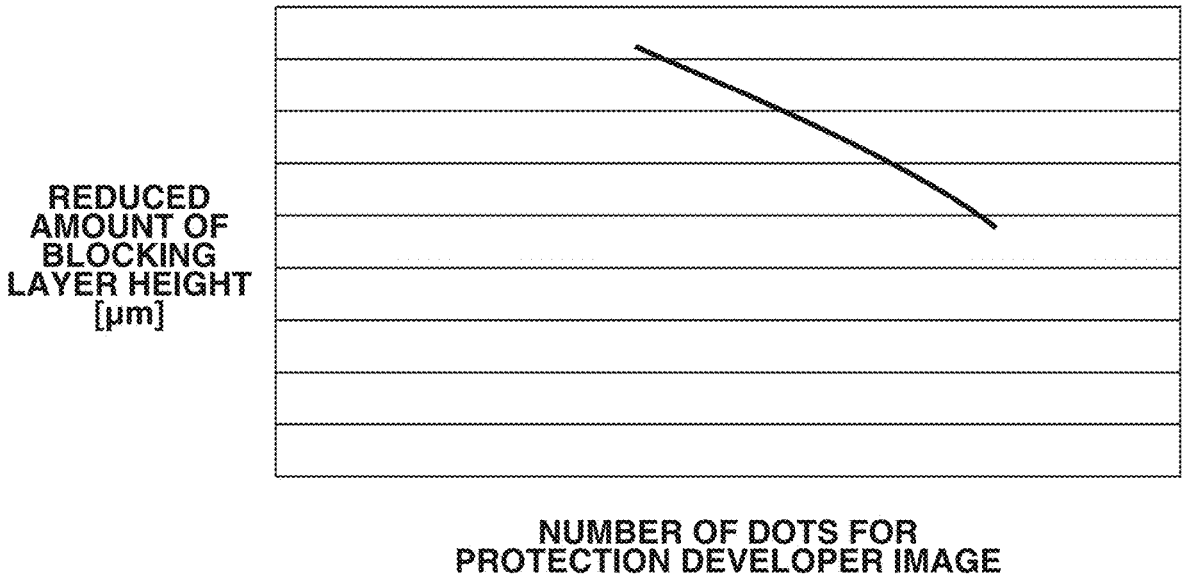
FIG. 21 illustrates a relation between the number of dots of a protection developer image and the reduced amount of a blocking layer height according to the fifth example embodiment.

FIG. 21 illustrates a relation between the number of dots of the protection developer image and the reduced amount of the blocking layer height under the conditions of the number of repetitions of toner discharge and the positive and negative applied biases in a certain mode. The horizontal axis is assigned the number of dots, and the vertical axis is assigned the reduced amount of the blocking layer height. The reduced amount of the blocking layer height can be reduced by increasing the number of dots.

According to the present example embodiment, the control unit 101 sets the number of dots of the protection developer image before collecting the discharge toner from the toner charging brush 11 as the number of dots with which faulty cleaning does not occur, and performs control to complement the reduced blocking layer 21 with the protection developer image after the discharge toner collection. For the number of dots of the protection developer image after the discharge toner collection, the control unit 101 sends the upper limit with which faulty cleaning does not occur to ensure a sufficient blocking layer height, instead of complementing the reduced blocking layer 21.

<Description of Toner Discharge Sequence>

The control unit 101 switches between the discharge control modes according to the amount of accumulation. Table 6 illustrates a relation among the amount of accumulation, the number of repetitions of toner discharge, the positive and negative applied biases at the discharge timing, and the number dots of the protection developer image. The following table is prestored in the memory 502 and suitably referenced by the control unit 101 (CPU 501).

TABLE 6

Relation between amount of accumulation and discharge condition

| | Amount of accumulation | Number of repetitions | Positive/ negative applied bias | Number of dots for protection developer image | |
|---|---|---|---|---|---|
| | | | | Before collection | After collection |
| A | Up to 4,000 | 5 | ±1.0 kV | 20 | 0 |
| B | 4,001-8,000 | 10 | ±1.0 kV | 30 | 0 |
| C | 8,001-12,000 | 15 | ±1.0 kV | 40 | 0 |
| D | 12,001-16,000 | 20 | ±1.5 kV | 40 | 40 |

When image forming (print job) is completed, the control unit 101 refers to Table 6 and selects a mode according to the amount of accumulation based on the video count processing according to the fourth example embodiment. The number of repetitions of the bias application and the amplitudes of the positive and negative applied biases corresponding to the selected mode serve as power source control conditions for the toner charging brush 11 at the timing T4 in the timing charts illustrated in FIGS. 12, 13, 15, and 16.

A generally preferable blocking layer height can be maintained by changing the number of dots of the protection developer image according to the discharge control mode. However, for example, if the protection developer image is sent too much in a low-temperature low-humidity environment, faulty cleaning will occur. More specifically, if a 60-dot protection developer image is supplied when the amount of accumulation is 12,001 to 16,000 at low temperature and low humidity, faulty cleaning may occur. Therefore, under the condition of the mode D, the control unit 101 differentiates the amount of the protection developer to be supplied before and after the collection of the discharge toner from the toner charging brush 11, as illustrated in Table 6. When the amount of accumulation reaches 16,000 during a printing operation, the control unit 101 interrupts the printing operation and, after continuously performing discharge control in the mode D, continuously resumes the printing operation.

Fourth Comparative Example

The control unit 101 determines the number of dots of the protection developer image before the discharge toner collection in each control mode illustrated in FIG. 20. More specifically, the number of dots is 20, 30, 40, and 60 during execution of the modes A, B, C, and D, respectively.

«Faulty Cleaning and Confirmation of Vertical Streak Prevention Effect»

At the present time, the control unit 101 confirmed whether a vertical streak image occurred after 6,000-sheet passing under the paper passing condition according to the fourth example embodiment. The result is illustrated in Table 7. Table 7 illustrates faulty cleaning and vertical streak generation status after 6,000-sheet passing according to the fifth example embodiment and the fourth comparative example.

TABLE 7

Faulty cleaning and vertical streak generation status after 6,000-sheet passing according to fifth example embodiment and fourth comparative example

| | | Amount of accumulation | Number of repetitions | Positive/negative applied bias |
|---|---|---|---|---|
| Fifth example embodiment | A | Up to 4,000 | 5 | ±1.0 kV |
| | B | 4,001-8,000 | 10 | ±1.0 kV |
| | C | 8,001-12,000 | 15 | ±1.0 kV |
| | D | 12,001-16,000 | 20 | ±1.5 kV |
| Fourth comparative example | A | Up to 4,000 | 5 | ±1.0 kV |
| | B | 4,001-8,000 | 10 | ±1.0 kV |
| | C | 8,001-12,000 | 15 | ±1.0 kV |
| | D | 12,001-16,000 | 20 | ±1.5 kV |

| | | Number of dots for protection developer image | | | |
|---|---|---|---|---|---|
| | | Before collection | After collection | Faulty cleaning | Vertical streaks |
| Fifth example embodiment | A | 20 | 0 | ○ | ○ |
| | B | 30 | 0 | ○ | ○ |
| | C | 40 | 0 | ○ | ○ |
| | D | 40 | 40 | ○ | ○ |
| Fourth comparative example | A | 20 | 0 | ○ | ○ |
| | B | 30 | 0 | ○ | ○ |
| | C | 40 | 0 | ○ | ○ |
| | D | 60 | 0 | x | ○ |

According to the fourth comparative example, in discharge control in the mode D, vertical streaks were not generated but faulty cleaning occurred particularly in the low-temperature low-humidity environment. According to the fifth example embodiment, faulty cleaning does not occur and vertical streaks were not generated, resulting in a preferable image.

<Configuration of Image Forming Apparatus According to Sixth Example Embodiment>

Unlike the second and the fourth example embodiment, the image forming apparatus according to the present example embodiment supplies at the same time the toner discharged from the toner charging brush 11 and the toner supplied from the development roller 17 to the cleaning blade 6 via the photosensitive drum 1. Other configurations are similar to those according to the fourth example embodiment. Adopting the collection method according to the present example embodiment enables reducing the time for collecting the toner from the development roller 17 as described in the fourth and fifth example embodiments.

Figure 22:
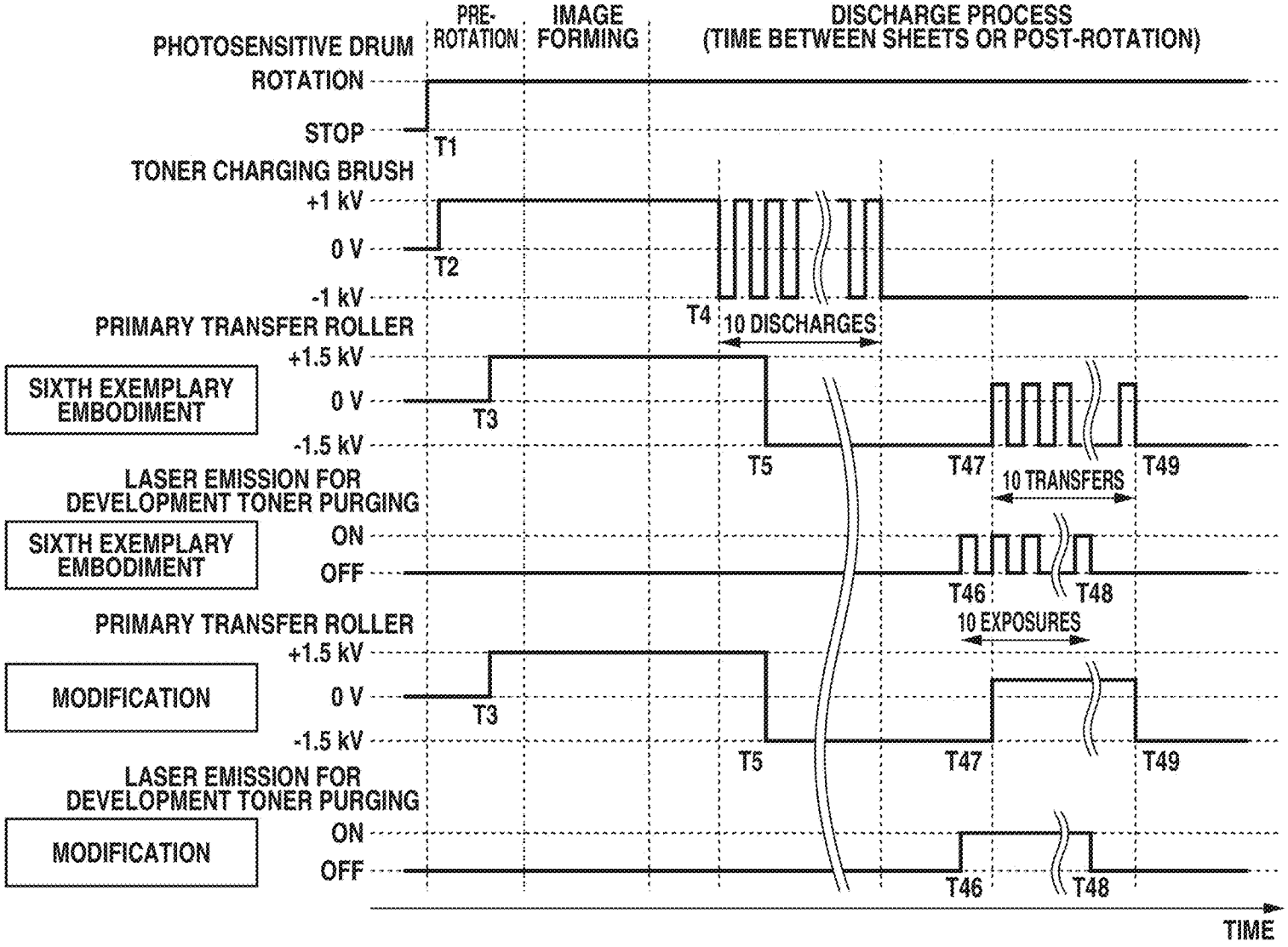
FIG. 22 is a timing chart illustrating a discharge process by a first image forming unit.
Figure 23:
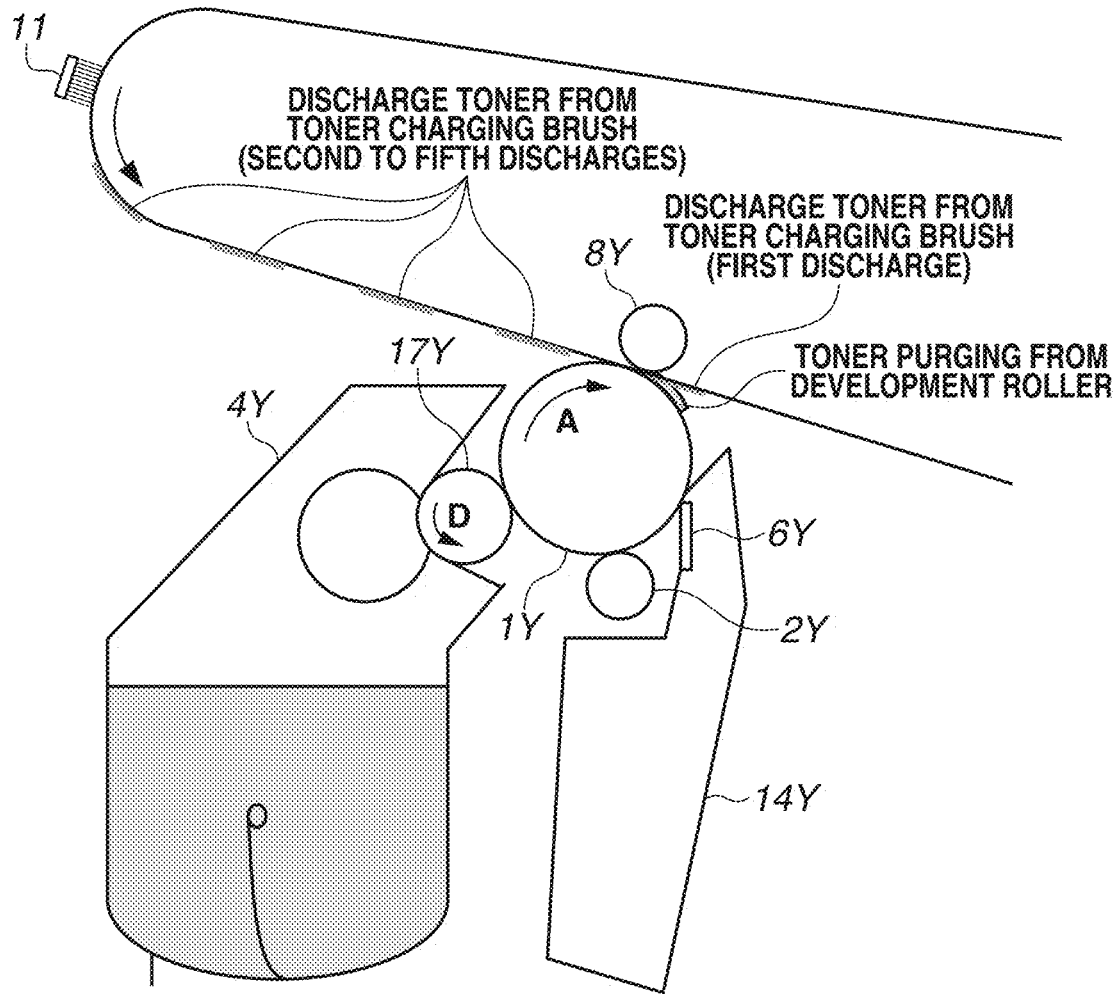
FIG. 23 is a cross-sectional view illustrating an image forming apparatus for describing a bias application timing for a toner charging brush, a primary transfer roller, and a development roller according to a sixth example embodiment.
Figure 24:
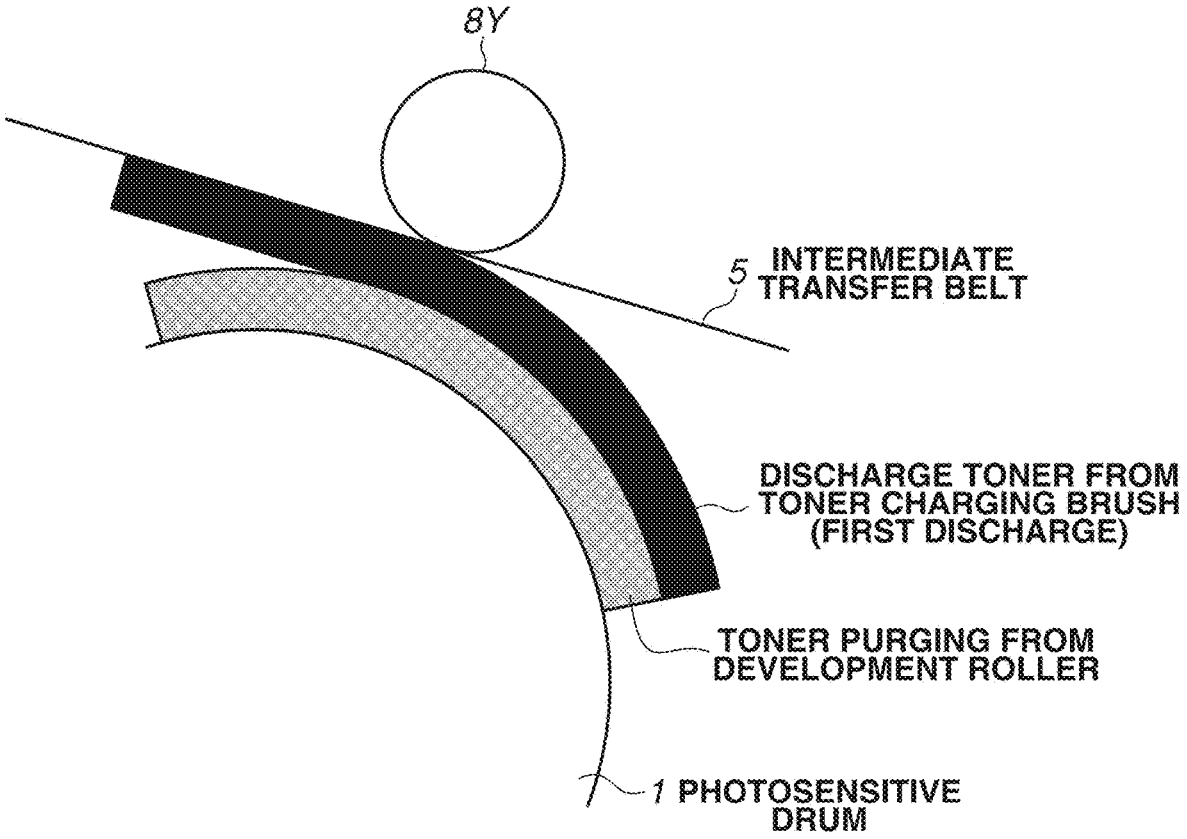
FIG. 24 illustrates the discharge toner from the development roller and a primary transfer state of the discharge toner from the toner charging brush.

FIGS. 22, 23, and 24 illustrate a timing of starting and stopping the rotation of the photosensitive drum 1, a timing of applying a positive bias and a negative bias to the toner charging brush 11 and the primary transfer roller 8, and a timing of laser emission for toner purging from the development roller 17 in the first image forming unit.

The timings T1 to T5 are similar to the timings T1 to T4 and T6 illustrated in FIG. 12, and detailed descriptions thereof will be omitted.

At the timing T46, the control unit 101 controls the scanner unit 3 to perform the laser emission for the protection developer image. This laser emission forms an electrostatic latent image for the protection developer image on the photosensitive drum 1. According to the sixth example embodiment, the control unit 101 performs the laser emission 10 times at 0.2-second intervals in order to synchronize with the operation for discharging toner from the toner charging brush 11 performed at the T4. Then, at the same time as the developer reversely transferred is supplied to the cleaning blade 6, developer (second developer) is supplied from the development roller 17 (developer bearing member) to the cleaning blade 6. The protection developer according to the present example embodiment was used to print a halftone image.

At the timing T47, the control unit 101 controls the high-voltage power source unit 512 to apply a negative bias to the primary transfer roller 8Y. Referring to FIG. 22, when the protection developer image formed at the timing T46 and the toner discharged from the toner charging brush 11 simultaneously pass the transfer portion, a positive reverse bias (having a polarity that is the same as the normal charging polarity of the developer) is applied to the primary transfer roller 8Y. However, the present disclosure is not limited thereto. It is confirmed that, even if the transfer bias applied to the primary transfer roller 8Y is turned off or if a transfer bias having a small negative value is applied to the primary transfer roller 8Y, a fixed amount of the protection developer is supplied to the cleaning blade 6.

The following describes relations between the timings T4 to T46, with reference to FIG. 23. As illustrated in FIG. 23, according to the present sixth example embodiment, toner for the protection developer image comes on the downstream side of the first discharge toner from the toner charging brush 11, on the photosensitive drum 1Y. Referring to positional relations between members, a distance L1 from the toner charging brush 11 to the position where the photosensitive drum 1Y of the first image forming unit contacts the intermediate transfer belt 5 is 150 mm. A distance L2 from the position of laser irradiation on the photosensitive drum 1Y by the scanner unit 3 to the position where the photosensitive drum 1Y contacts the intermediate transfer belt 5 is 50 mm.

In this configuration according to the present sixth example embodiment, with reference to the timing when the toner charging brush 11 starts being applied with a discharge bias (−1 kV), the discharge toner from the toner charging brush 11 reaches the position 50 mm before the photosensitive drum 1Y, in 0.5 seconds. When the photosensitive drum 1Y is simultaneously irradiated with laser, the toner discharged first from the toner charging brush 11 and the toner purged first from the development roller 17Y simultaneously reach the position where the photosensitive drum 1Y contacts the intermediate transfer belt 5.

When the control unit 101 performs the laser emission 10 times at 0.2-second intervals since the photosensitive drum 1Y is irradiated with laser, the timing of toner discharge from the toner charging brush 11 and the timing of toner purging from the development roller 17Y can be completely synchronized with each other. This makes it possible to simultaneously supply the toner discharged from the toner charging brush 11 and the protection developer to the cleaning blade 6.

At the moment when the toner charging brush 11 is applied with the −1-kV bias, the primary transfer roller 8Y is applied with the negative bias in order to collect (reversely transfer) the negative discharge toner from the toner charging brush 11 to the photosensitive drum 1.

For specific example, the control unit 101 changes the bias of the primary transfer roller 8Y to −1.5 kV at 0.5 seconds after the toner charging brush 11 is applied with the discharge bias (timing T5). These operations make it possible to form a blocking layer 21 at the edge portion of the cleaning blade 6 and, at the same time, collect the discharge toner from the toner charging brush 11 to the photosensitive drum 1.

FIG. 24 illustrates the discharge toner from the development roller 17 and a primary transfer state of the discharge toner from the toner charging brush 11, i.e., simultaneous collection control in which the first and second developers are simultaneously supplied to the cleaning member. As illustrated in FIG. 24, an enlarged view of the vicinity of the primary transfer roller 8Y of the first image forming unit, the toner for blocking layer forming is coated on the drum side and then the toner discharged from the toner charging brush 11 is to be coated thereon. Thus, the toner discharged from the toner charging brush 11 which destroys the blocking layer 21 can be physically kept away from the edge portion of the cleaning blade 6. Then, supplying toner for blocking layer forming at the same time enables preventing faulty cleaning through discharge control in a shorter time. In addition, the time period in seconds since the time when the toner charging brush 11 is applied with the discharge bias till the time when the scanner unit 3 performs the laser emission for the protection developer image is suitably determined by the distance L2 and the diameter of and the photosensitive drum 1.

Although, in the present example embodiment, the positive toner discharged from the toner charging brush 11 is collected in the first image forming unit, the toner may be collected in any one of the second to fourth image forming units.

According to a modification of the sixth example embodiment illustrated in FIG. 22, the control unit 101 continuously performs the laser emission, instead of intermittently performing the laser emission for toner purging from the development roller 17 as in the sixth example embodiment.

In this case, the cleaning blade 6 simultaneously collects the negative toner discharged from the toner charging brush 11 and the negative toner purged from the development roller 17.

Also in this configuration, the discharge toner from the toner charging brush 11 reaches the position before 50 mm from the photosensitive drum 1Y in 0.5 seconds, as in the sixth example embodiment. When the photosensitive drum 1Y is simultaneously irradiated with laser, the toner discharged first from the toner charging brush 11 and the toner purged first from the development roller 17Y simultaneously reach the position where the photosensitive drum 1Y contacts the intermediate transfer belt 5.

If laser emission is continued for 4 seconds since the timing when the photosensitive drum 1Y is irradiated with laser, the end of the discharge toner from the toner charging brush 11 in the 10th discharge can be completely synchronized with the timing of toner purging from the development roller 17Y.

In this case, the cleaning blade 6 simultaneously collects the negative toner discharged from the toner charging brush 11 and the negative toner purged from the development roller 17.

This makes it possible to form a more robust blocking layer 21 before the positive toner collection.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Applications No. 2018-125005, filed Jun. 29, 2018, and No. 2019-078792, filed Apr. 17, 2019, which are hereby incorporated by reference herein in their entirety.

What is claimed is:

1. An image forming apparatus capable of performing an image forming operation for forming an image on a recording material, the image forming apparatus comprising:

an image bearing member configured to be rotatable;

an exposure unit configured to expose a surface of the image bearing member so as to form an electrostatic latent image on the image bearing member surface;

a developer bearing member configured to supply developer to the electrostatic latent image so as to form a developer image on the image bearing member surface, wherein the developer bearing member, bearing the developer, contains additive particles;

an intermediate transfer member configured to form a transfer portion in contact with the image bearing member;

a transfer member configured to transfer the developer image developed on the image bearing member surface onto the intermediate transfer member at the transfer portion;

a holding unit configured to collect, after the developer image transferred on the intermediate transfer member has been transferred onto the recording material, residual developer remaining on the intermediate transfer member and temporarily hold the residual developer;

a cleaning member configured to remove developer borne by the image bearing member, wherein the cleaning member forms a contact portion when in contact with the image bearing member; and a controller configured to control to perform the image forming operation and a cleaning operation for moving a collected developer held by the holding unit to the intermediate transfer member and then for reversely transferring the collected developer from the intermediate transfer member to the image bearing member, wherein, when a non-image forming operation which performs an operation other than the image forming operation is performed, the controller controls to reversely transfer the collected developer, which has been moved to the intermediate transfer member by the cleaning operation, from the intermediate transfer member to a first region on the image bearing member at the transfer portion, and controls to supply the developer from the developer bearing member to the contact portion on the image bearing member surface by exposing a second region on the image bearing member surface and supplying the developer from the developer bearing member to the exposed second region, and wherein the controller controls such that the second region on the image bearing member surface passes through the contact portion before the first region on the image bearing member surface passes through the contact portion.

2. The image forming apparatus according to claim 1, further comprising a bias application unit configured to apply bias to the transfer member, wherein, in a case where the second region to which the developer is supplied passes the transfer portion, the controller performs control in such a manner that the transfer member (i) is not applied with a bias, or (ii) is applied with (iia) a bias having a polarity that is the same as a normal charging polarity of the developer or (iib) a bias having a polarity opposite to the normal charging polarity of the developer.

3. The image forming apparatus according to claim 1, wherein, before the developer having moved from the holding unit to the intermediate transfer member reaches the transfer portion, the developer passes the transfer portion, and the additive particles are supplied to the contact portion of the cleaning member in contact with the image bearing member.

4. The image forming apparatus according to claim 1, wherein the holding unit includes a charging member, and wherein the charging member charges the collected developer by applying a bias having a polarity opposite to a charging polarity of the developer.

5. The image forming apparatus according to claim 4, wherein, to move the collected developer held in the holding unit onto the intermediate transfer member, the charging member alternately applies a bias having a polarity that is the same as a normal charging polarity of the developer and a bias having a polarity opposite to the normal charging polarity of the developer.

6. The image forming apparatus according to claim 1, further comprising:

a second image bearing member configured to be rotatable;

a second developer bearing member configured to supply developer to the electrostatic latent image so as to form a second developer image on a surface of the second image bearing member, wherein the second developer bearing member, bearing the developer, contains additive particles;

a second cleaning member configured to remove the developer borne by the second image bearing member at a second contact portion, wherein the second cleaning member forms the second contact portion in contact with the second image bearing member; and a bias application unit configured to apply bias to the intermediate transfer member, wherein the intermediate transfer member transfers the second developer image formed on the second image bearing member onto the intermediate transfer member at a second transfer portion at which the second image bearing member and the intermediate transfer member come in contact with one another, wherein the controller controls to reversely transfer the collected developer, which has been moved to the intermediate transfer member by the cleaning operation, from the intermediate transfer member to a third region on the second image bearing member at the second transfer portion, and controls to supply the developer to the second contact portion on the second image bearing member surface by exposing a fourth region on the second image bearing member surface and supplying the developer from the second developer bearing member to the exposed fourth region, wherein the controller controls such that the fourth region on the second image bearing member surface passes through the second contact portion before the third region on the second image bearing member surface passes through the second contact portion, and wherein, when the developer passes the second transfer portion, (A) the intermediate transfer member (i) is not applied with a bias, or (ii) is applied with (iia) a bias having a polarity that is the same as a normal charging polarity of the passed developer (iib) or a bias having a polarity opposite to the normal charging polarity of the passed developer, and then (B) the intermediate transfer member is applied with a bias having a polarity that is the same as the normal charging polarity of the passed developer.

7. The image forming apparatus according to claim 6, wherein the developer bearing member is a first developer bearing member, wherein the cleaning member is arranged upstream of the second cleaning member in a moving direction of the intermediate transfer member surface, and is arranged downstream of the holding unit in the moving direction, and wherein an amount of the developer on the second developer bearing member is smaller than an amount of the developer on the first developer bearing member.

8. The image forming apparatus according to claim 6, wherein a timing when part of the developer reaches the second transfer portion formed by the intermediate transfer member and the intermediate transfer member differs from a timing when the developer on the second developer bearing member reaches the second transfer portion.

9. The image forming apparatus according to claim 1, wherein, when the additive particles are supplied to the contact portion where the cleaning member contacts the image bearing member, a layer of the additive particles is formed at the contact portion.

10. An image forming apparatus capable of performing an image forming operation for forming an image on a recording material, the image forming apparatus comprising:

an image bearing member configured to be rotatable;

an exposure unit configured to expose a surface of the image bearing member so as to form an electrostatic latent image on the image bearing member surface;

a developer bearing member configured to supply developer to the electrostatic latent image so as to form a developer image on the image bearing member surface, wherein the developer bearing member, bearing the developer, contains additive particles;

an intermediate transfer member configured to form a transfer portion in contact with the image bearing member;

a transfer member configured to transfer the developer image developed on the image bearing member surface onto the intermediate transfer member at the transfer portion;

a holding unit configured to collect, after the developer image transferred on the intermediate transfer member has been transferred onto the recording material, residual developer remaining on the intermediate transfer member and temporarily hold the residual developer, wherein the holding unit includes a charging member and, by applying a voltage having a polarity opposite to a charging polarity of the developer used for developing an electrostatic latent image, the charging member charges the developer borne by the intermediate transfer member;

a cleaning member configured to remove developer borne by the image bearing member, wherein the cleaning member forms a contact portion when in contact with the image bearing member; and a controller configured to control to perform a cleaning operation for moving a collected developer held by the holding unit to the intermediate transfer member and then for reversely transferring the collected developer from the intermediate transfer member to the image bearing member, wherein, in a case where a voltage of the developer charging polarity and the voltage having the polarity opposite to the developer charging polarity are alternately applied to move the collected developer held by the holding unit to the intermediate transfer member, the charging member gradually increases a voltage difference between the voltage of the developer charging polarity and the voltage having the polarity opposite to the developer charging polarity that are alternately applied.

11. The image forming apparatus according to claim 10, further comprising an environmental sensor, wherein, in a case where a temperature detected by the environmental sensor is equal to or lower than a predetermined temperature, the charging member applies the voltage having the polarity opposite to the developer charging polarity by alternately fluctuating a magnitude of the voltage having the polarity opposite to the developer charging polarity while gradually increasing a range of the magnitude fluctuation.

12. An image forming apparatus capable of performing an image forming operation for forming an image on a recording material, the image forming apparatus comprising:

an image bearing member configured to be rotatable;

an exposure unit configured to expose a surface of the image bearing member so as to form an electrostatic latent image on the image bearing member surface;

a developer bearing member configured to supply developer to the electrostatic latent image so as to form a developer image on the image bearing member surface, wherein the developer bearing member, bearing the developer, contains additive particles;

an intermediate transfer member configured to form a transfer portion in contact with the image bearing member;

a transfer member configured to transfer the developer image developed on the image bearing member surface onto the intermediate transfer member at the transfer portion;

a holding unit configured to collect, after the developer image transferred on the intermediate transfer member has been transferred onto the recording material, residual developer remaining on the intermediate transfer member and temporarily hold the residual developer;

a cleaning member configured to remove developer borne by the image bearing member, wherein the cleaning member forms a contact portion when in contact with the image bearing member; and a controller configured to control to perform the image forming operation and a cleaning operation for moving a collected developer held by the holding unit to the intermediate transfer member and then for reversely transferring the collected developer from the intermediate transfer member to the image bearing member, wherein, when a non-image forming operation which performs an operation other than the image forming operation is performed, the controller controls to reversely transfer the collected developer, which has been moved to the intermediate transfer member by the cleaning operation, from the intermediate transfer member to a first region on the image bearing member at the transfer portion, and controls to supply the developer from the developer bearing member to the contact portion on the image bearing member surface by exposing a fifth region on the image bearing member surface and supplying the developer from the developer bearing member to the exposed fifth region, and wherein the controller controls such that the fifth region on the image bearing member surface passes through the contact portion after the first region on the image bearing member surface passes through the contact portion.

* * * * *